US007504188B2

(12) United States Patent
Yamada et al.

(10) Patent No.: US 7,504,188 B2
(45) Date of Patent: Mar. 17, 2009

(54) TONER AND DEVELOPER, TONER CONTAINER, PROCESS CARTRIDGE, IMAGE FORMING APPARATUS, AND IMAGE FORMING METHOD USING THE SAME

(75) Inventors: Masahide Yamada, Numazu (JP); Ryota Inoue, Mishima (JP); Naohiro Watanabe, Shizuoka (JP); Shigeru Emoto, Numazu (JP); Masahiro Ohki, Iruma (JP); Akinori Saitoh, Numazu (JP); Tsunemi Sugiyama, Kashiwa (JP); Shinichi Wakamatsu, Numazu (JP); Toshiki Nanya, Mishima (JP); Naohito Shimota, Numazu (JP); Hiroshi Yamada, Numazu (JP); Junichi Awamura, Numazu (JP); Tomomi Suzuki, Numazu (JP); Kazuyuki Hirai, Kyoto (JP); Kazushige Yasumatsu, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/938,335

(22) Filed: Nov. 12, 2007

(65) Prior Publication Data

US 2008/0090165 A1 Apr. 17, 2008

Related U.S. Application Data

(63) Continuation of application No. PCT/JP2006/309766, filed on May 10, 2006.

(30) Foreign Application Priority Data

May 10, 2005 (JP) ..... 2005-137291
May 17, 2005 (JP) ..... 2005-144453

(51) Int. Cl.
*G03G 9/08* (2006.01)

(52) U.S. Cl. ..... 430/109.4

(58) Field of Classification Search ..... 430/109.4
See application file for complete search history.

(56) References Cited

U.S. PATENT DOCUMENTS 5,578,409 A * 11/1996 Kotaki et al. ..... 430/108.8

FOREIGN PATENT DOCUMENTS

| | | |
|---|---|---|
| JP | 51-23354 | 7/1976 |
| JP | 60-20411 | 5/1985 |
| JP | 60-90344 | 5/1985 |

(Continued)

OTHER PUBLICATIONS

Machine translation of JP 2005-115347.*

(Continued)

*Primary Examiner*—Mark A Chapman
(74) *Attorney, Agent, or Firm*—Oblon, Spivak, McClelland, Maier & Neustadt, P.C.

(57) ABSTRACT

To provide a toner containing an ethyl acetate-soluble polyester component and an ethyl acetate-insoluble polyester component, wherein the toner is granulated in an aqueous medium, the ethyl acetate-insoluble polyester component is obtained by elongating and/or cross-linking a modified polyester resin during granulating and/or after granulating, the modified polyester resin is produced by condensation polymerization of an acid component and at least one type of diol compound selected from aliphatic diol and alicyclic diol in the presence of a catalyst, and the mass average molecular weight of the modified polyester resin is 10,000 to 100,000.

12 Claims, 9 Drawing Sheets

FOREIGN PATENT DOCUMENTS

| | | |
|---|---|---|
| JP | 62-63940 | 3/1987 |
| JP | 64-15755 | 1/1989 |
| JP | 2-82267 | 3/1990 |
| JP | 3-41470 | 2/1991 |
| JP | 3-229264 | 10/1991 |
| JP | 7-56390 | 3/1995 |
| JP | 2537503 | 7/1996 |
| JP | 9-34167 | 2/1997 |
| JP | 2931899 | 5/1999 |
| JP | 11-149180 | 6/1999 |
| JP | 11-184283 | 7/1999 |
| JP | 11-305486 | 11/1999 |
| JP | 2002-287400 | 10/2002 |
| JP | 2002-351143 | 12/2002 |
| JP | 2004-334122 | 11/2004 |
| JP | 2005-84566 | 3/2005 |
| JP | 2005-91696 | 4/2005 |
| JP | 2005-115019 | 4/2005 |
| JP | 2005-115347 | 4/2005 |

OTHER PUBLICATIONS

U.S. Appl. No. 12/047,807, filed Mar. 13, 2008, Honda, et al.

* cited by examiner

TONER AND DEVELOPER, TONER CONTAINER, PROCESS CARTRIDGE, IMAGE FORMING APPARATUS, AND IMAGE FORMING METHOD USING THE SAME

CROSS-REFERENCE TO RELATED APPLICATION

This is a continuation of Application No. PCT/JP2006/309766, filed on May 10, 2006.

BACKGROUND OF THE INVENTION

1. Field of the Invention

The present invention relates to a toner for developing static charge images in electrophotography, electrostatic recording and electrostatic printing, and a developer, a toner container, a process cartridge, an image forming apparatus and an image forming method using the toner respectively.

2. Description of the Related Art

The image forming method for electrophotography, electrostatic recording and electrostatic printing, etc. includes development step in which a toner contained in a developer is attached once to an image bearing member such as photoconductor on which a static charge image is formed, transferring step in which the toner is transferred from the photoconductor to a transfer medium such as transfer paper and fixing step in which the toner is fixed on the paper.

In the fixing step, the surface of the roller has been formed of a material such as silicone rubber or fluorine resin having an excellent releasing property relative to the toner in order to prevent attachment of the toner onto the surface of the fixing roller and a thin film of liquid having a high releasing property such as silicone oil and fluorine oil is applied to the roller surface in order to prevent offset and fatigue of the roller surface.

This method is significantly effective in terms of preventing offset of the toner, however, since a feeding unit for offset preventing liquid is needed making the fixing apparatus more complicated, it is disadvantageous for energy conservation and moreover, separation between layers making up the fixing roller is induced by the oil application leading to facilitation of short life span of the fixing roller.

For this reason, oilless fixing apparatuses which do not employ feeding units for silicone oils have been proposed recently.

Because the toner used for this oilless fixing is needed to have releasing property relative to the surface of the fixing member to some extent, the viscoelasticity of the toner is increased by increasing polymerization degree of the resin, or instead of applying oil on the surface of the fixing roller, releasing agents such as low-molecular-weight polypropylene is added in the toner particles to feed the offset preventing liquid from the toner particles during heating and to provide peel property relative to the surface of fixing member.

For example, an oilless color toner in which releasing agent-including resin particles, which are granulated by mixing releasing agent emulsion in an emulsified polyester dispersion liquid and colored with dyes, is disclosed in Japanese Patent Application Laid-Open (JP-A) No. 7-56390. By having such composition, a toner which excels in color reproducibility, and exhibits excellent offset resistance, winding resistance and fixing property even in oilless fixing can be obtained.

At the same time, toners used in these thermal-roller type fixing apparatuses are desirably having a lower limit of fixing temperature lowered as much as possible while maintaining the hot offset resistance.

In particular, many oilless fixing apparatuses such as above are often equipped with cleaning rollers which are in contact with fixing rollers or pressure rollers for removal of the toner attached to the surface of the fixing roller. When such fixing apparatuses are used for prolonged periods, the toner accumulated on the fixing cleaning roller is melted by heat and causes inverted hot offset, a defect caused by the melted toner which is reversely transferred to the fixing rollers or pressure rollers.

For this reason, approaches have been made to prevent melting of the toner from the cleaning rollers by decreasing the working temperature of the fixing rollers and fixing cleaning rollers.

When the thermal-roller type fixing apparatuses are used with the decreased fixing roller temperature, more improvement on low-temperature fixing property of the toner is required.

However, decreasing the fixing temperature of the toner poses a problem of difficulty in securing fixing temperature regions (hot offset resistance) and maintaining heat-resistant storage property.

As a method to satisfy both demands, making the molecular weight distribution of toner binders a wide region including low molecular weight to high molecular weight, have been proposed in the past (Japanese Patent Application Publication (JP-B) Nos. 60-20411 and 51-23354, for example).

However, when molecular weight of the toner binder is reduced in the low molecular weight regions or fixing temperature of the toner is lowered by increasing the ratio of low molecular weight components, storage stability in high-temperature regions is degraded and fusion during running becomes notable and also, troubles such as deterioration of image quality due to the change in charged amount may likely to occur.

Moreover, toners which excel in low-temperature fixing property, hot offset resistance and heat-resistant storage property, which are obtained from manufacturing methods including molecular-weight increasing step in which polyaddition reaction of isocyanate group-contained polyester prepolymer with amine in organic solvents and aqueous media is performed have been disclosed (JP-A Nos. 2002-287400 and 2002-351143, for example).

However, when the toner, which is produced by the above methods, is used with the decreased fixing roller temperature, fixing becomes insufficient and more improvement of low-temperature fixing property is required.

Furthermore, in the electrophotographic image forming in general, an electrical latent image is formed on a photoconductor, which is prepared by using photoconductive material, by means of various units. After the latent image is developed using a developer, the developed image is transferred to paper, etc. accordingly and then fixed by heat, pressure or solvent moisture.

The development methods of electrical latent images can be classified broadly into two categories: liquid developing method in which liquid developers prepared by finely dispersing various pigments or dyes in insulating organic liquids is employed, and dry developing method in which dry developers (hereinafter may be referred to as "toner") prepared by dispersing colorants such as carbon black in resins as in cascade development, magnetic brush development and powder cloud development. Of these, dry developing method is widely used in late years.

The heat roller is widely used in general for the fixing in the dry developing method because of its excellent energy efficiency. Furthermore, thermal energy provided for the toner during fixing is tend to be reduced in an attempt to enhance energy conservation by the decrease in fixing temperature of the toner in recent years. A technology procurement project for copiers of next generation exists in the DSM (demand-side management) program of International Energy Association (IEA) in 1999 and its requirement specifications have been officially announced. For the copiers of 30 cpm or more, achievement of dramatic energy conservation compared to traditional copiers such as within 10 seconds of waiting time and 10 watts to 30 watts or less (depending on copying speeds) of power consumption during waiting, is required. As one of the methods to fulfill the requirements, temperature-responsive property of the toner may be improved by decreasing the heat capacity of the fixing member such as heat rollers; however, it is not satisfactory.

In order to fulfill the above requirements and significantly shorten the waiting time, lowering the fixing temperature of the toner itself in order to lower the fixing temperature of the toner when usable is considered to be technically an essential fulfillment items.

In an attempt to meet such decrease in fixing temperatures, polyester resins having excellent low-temperature fixing properties and relatively favorable heat-resistant storage properties are being tried for use in place of frequently used styrene-acrylic resins (JP-A Nos. 60-90344, 64-15755 2-82267 JP 3-229264, 3-41470 and 11-305486). Moreover, an attempt to add specific non-olefin crystalline polymers in binders for the purpose of improving low-temperature fixing property (JP-A No. 62-63940) and an attempt to employ crystalline polyesters (Japanese Patent (JP-B) No. 2931899) have been proposed, however, molecular structure and molecular weight of the polyester resins are not optimized in these proposals.

Furthermore, it is impossible to fulfill the specifications of the DSM program even if these known conventional arts are applied, and the establishment of low-temperature fixing technology which is more advanced than conventional technologies is needed.

For further decrease in fixing temperatures, controlling heat properties of the resin itself becomes necessary, however, if the glass transition temperature (Tg) is lowered too much, heat-resistant storage property may be degraded and if the molecular weight is reduced and the F1/2 temperature of the resin is lowered too much, hot offset generation temperature may be lowered. Because of these issues, a toner having an excellent low-temperature property and high hot offset generation temperature have not yet been obtained by controlling heat properties of the resin itself.

Next, manufacturing method of the toner used for developing static charge images can be broadly classified into pulverization and polymerization.

In pulverization, colorants, charge controlling agents and offset preventing agents are fusion mixed and dispersed evenly in a thermoplastic resin and a toner is produced by pulverizing and classifying the obtained toner composition. It is possible to produce the toner which has excellent properties to some extent by pulverization; however, material selection is limited. In other words, the toner composition obtained from fusion mixing has to be capable of being pulverized and classified by means of an affordable apparatus. Because of this requirement, fusion mixed toner composition must be sufficiently brittle. When the toner composition is actually pulverized to become particles, the mass average particle diameter of the toner must be reduced, for example, in order to obtain copied images with which particle diameter distribution of broader region is likely to be formed with appropriate resolution and tone, and there is a disadvantage of having extremely low toner yield because fine powder of 4 μm or less particle diameter and coarse powder of 15 μm or more particle diameter must be removed by classification. Moreover, it is difficult to disperse colorants or charge controlling agents evenly in a thermoplastic resin in pulverization and uneven dispersion brings harmful effects on flowability, developing property, durability and image quality of the toner.

In late years, manufacturing methods of toner using polymerization have been proposed and operated in order to overcome these problems associated with pulverization. For example, toner particles are obtained by suspension polymerization or emulsion polymerization condensation (JP-B No. 2537503).

However, it is difficult to produce the toner by using polyester resins which are advantageous in low-temperature fixing properties in these manufacturing methods of the toner.

To settle above issues, a toner of polyester resin which is spheronized in water using solvents (JP-A No. 9-34167) and a toner using isocyanate reaction (JP-A No. 11-149180) have been proposed, for example. However, low-temperature fixing properties and toner productivity were not sufficient in any of these proposals.

Therefore, the toner which is capable of pursuing excellent low-temperature fixing property and offset resistance simultaneously to form appropriate images of high resolution and related techniques thereof are not yet provided and their prompt provision is desired in the present situation.

BRIEF SUMMARY OF THE INVENTION

It is an object of the present invention to provide a toner which has excellent low-temperature fixing property and capable of maintaining heat-resistant storage property and forming an image of high quality which exhibits appropriate developability for prolonged periods, and an image forming apparatus and an image forming method using the toner respectively.

It is also an object of the present invention to provide a toner which is capable of pursuing excellent low-temperature fixing property and offset resistance simultaneously to form appropriate images of high resolution, and a developer, toner container, process cartridge, image forming apparatus and image forming method using the toner respectively.

The means to settle above issues are as follows.

<1> A toner containing a binder resin and a colorant, wherein the binder resin contains secondary modified polyester which can be obtained by cross-linking a primary modified polyester (B) derived from polyester as a precursor (A), and the mass average molecular weight of the precursor (A) is 10,000 to 90,000.

<2> The toner as stated in above <1>, wherein the precursor (A) is modified and at least a region which is capable of reacting with an active hydrogen group is introduced in the primary modified polyester (B).

<3> The toner as stated in above <1> and <2>, wherein the secondary modified polyester is obtained by reacting the primary modified polyester (B) with an active hydrogen group-containing compound (C).

<4> The toner as stated in above <1> to <3>, wherein the functional group contained in the primary modified polyester (B) is an isocyanate group.

<5> The toner as stated in above <1> to <4>, wherein the toner is granulated in an aqueous medium.

<6> The toner as stated in above <1> to <5>, wherein the toner is produced by dispersing an oil layer in an aqueous medium to obtain an emulsified dispersion liquid, elongating and/or cross-linking the primary modified polyester (B) with an active hydrogen group-containing compound (C) in the emulsified dispersion liquid to form toner particles and removing the organic solvent in the emulsified dispersion liquid, wherein the oil layer is obtained by dissolving or dispersing a toner composition containing a binder component containing the primary modified polyester (B) and the active hydrogen group-containing compound (C) in an organic solvent, and the primary modified polyester (B) contains a region capable of reacting with an active hydrogen group.

<7> The toner as stated in above <1> to <6>, wherein the glass transition temperature (Tg) of the precursor (A) is 30° C. to 50° C.

<8> The toner as stated in above <1> to <7>, wherein the glass transition temperature (Tg) is in the range of 40° C. to 55° C.

<9> A toner containing an ethyl acetate-soluble polyester component and an ethyl acetate-insoluble polyester component, wherein the toner is granulated in an aqueous medium, the ethyl acetate-insoluble polyester component is obtained by elongating and/or cross-linking a modified polyester resin during granulating and/or after granulating, the modified polyester resin contains condensation polymerization of an acid component and at least one type of diol compound selected from aliphatic diol and alicyclic diol, and the mass average molecular weight of the modified polyester resin is 10,000 to 100,000.

<10> A toner containing an ethyl acetate-soluble polyester component and an ethyl acetate-insoluble polyester component, wherein the toner is granulated in an aqueous medium, the ethyl acetate-insoluble polyester component is obtained by elongating and/or cross-linking a modified polyester resin during granulating and/or after granulating, the modified polyester resin contains condensation polymerization of an acid component and at least one type of diol compound selected from aliphatic diol and alicyclic diol in the presence of a catalyst, and the mass average molecular weight of the modified polyester resin is 10,000 to 100,000.

<11> The toner as stated in above <9> and <10>, wherein the ethyl acetate-insoluble polyester component contains a cross-linking point in a molecular chain.

<12> The toner as stated in above <9> to <11>, wherein the ethyl acetate-insoluble polyester component contains a gel component.

<13> A toner containing an active hydrogen group-containing compound and a polymer capable of reacting with the active hydrogen group-containing compound, wherein the toner is obtained by emulsifying and/or dispersing a toner solution in an aqueous medium to prepare a dispersion liquid after dissolving and/or dispersing a toner material containing the active hydrogen group-containing compound and the polymer capable of reacting with the active hydrogen group-containing compound in an organic solvent to prepare the toner solution and by reacting the active hydrogen group-containing compound and the polymer capable of reacting with the active hydrogen group-containing compound to generate an adhesive base material in form of particles, the polymer capable of reacting with the active hydrogen group-containing compound is a modified polyester resin, the modified polyester resin contains condensation polymerization of an acid component and at least one type of diol compound selected from aliphatic diol and alicyclic diol in the presence of a catalyst, and the mass average molecular weight of the modified polyester resin is 10,000 to 100,000.

<14> The toner as stated in above <9> to <13>, wherein the modified polyester resin contains an isocyanate group.

<15> The toner as stated in above <14>, wherein the rate of content of the isocyanate group based on JIS K1603 in the modified polyester resin is 2.0% by mass or less.

<16> The toner as stated in above <9> to <15>, wherein the diol compound is at least one type selected from 1,4-butanediol, propylene glycol, ethylene glycol, diethylene glycol, neopentyl glycol and 1,6-hexanediol.

<17> The toner as stated in above <9> to <16>, wherein the acid component is at least any one of terephthalic acid and isophthalic acid.

<18> The toner as stated in above <9> to <17>, wherein the catalyst is a Ti catalyst.

<19> The toner as stated in above <1> to <18>, wherein the volume average particle diameter (Dv) of the toner is 3 μm to 8 μm.

<20> The toner as stated in above <1> to <19>, wherein a ratio of the volume average particle diameter (Dv) to the number average particle diameter (Dn), Dv/Dn is 1.25 or less.

<21> A developer containing a toner, wherein the toner is the toner as stated in above <1> to <20>.

<22> A toner container containing a toner, wherein the toner is the toner as stated in above <1> to <20>.

<23> A process cartridge containing a latent electrostatic image bearing member, and a developing unit configured to develop a latent electrostatic image formed on the latent electrostatic image bearing member using a toner to form a visible image, wherein the toner is the toner as stated in above <1> to <20>.

<24> An image forming apparatus containing a latent electrostatic image bearing member, a latent electrostatic image forming unit configured to form a latent electrostatic image on the latent electrostatic image bearing member, a developing unit configured to develop the latent electrostatic image using a toner to form a visible image, a transfer unit configured to transfer the visible image to a recording medium, and a fixing unit configured to fix the transferred image to the recording medium, wherein the toner is the toner as stated in above <1> to <20>.

<25> The image forming apparatus as stated in above <24>, wherein the fixing unit contains a fixing roller configured to apply at least any one of heat and pressure to the transferred image on the recording medium and a fixing cleaning roller configured to remove a residual toner on the fixing roller.

<26> An image forming method containing forming a latent electrostatic image on the latent electrostatic image bearing member, developing the latent electrostatic image using a toner to form a visible image, transferring the visible image to a recording medium, and fixing the transferred image to the recording medium, wherein the toner is the toner as stated in above <1> to <20>.

<27> The image forming method as stated in above <26>, wherein the visible image is fixed on the recording medium by applying at least any one of heat and pressure by means of the fixing roller in fixing, and a residual toner on the fixing roller is removed by means of the fixing cleaning roller.

In the first embodiment, the toner of the present invention at least contains binder resin and colorant, and the binder resin contains a secondary modified polyester which is obtained by cross-linking the primary modified prepolymer (B) having polyester as a precursor (A) and the mass average molecular weight of the precursor (A) is 10,000 to 90,000.

In the second embodiment, the toner of the present invention is granulated in an aqueous medium and contains at least ethyl acetate-soluble polyester component and ethyl acetate-insoluble polyester component. The ethyl acetate-insoluble polyester component is obtained by elongating and/or cross-linking the modified polyester resin, which is a precursor of the ethyl acetate-insoluble polyester component during granulating and/or after granulating. The modified polyester resin is obtained by performing condensation polymerization of acid component and at least one type of diol compound selected from aliphatic diol and alicyclic diol and the mass average molecular weight of the modified polyester resin is 10,000 to 100,000.

In the third embodiment, the toner of the present invention is granulated in an aqueous medium and contains at least ethyl acetate-soluble polyester component and ethyl acetate-insoluble polyester component. The ethyl acetate-insoluble polyester component is obtained by elongating and/or cross-linking the modified polyester resin, which is a precursor of the ethyl acetate-insoluble polyester component during granulating and/or after granulating. The modified polyester resin is obtained by performing condensation polymerization of acid component and at least one type of diol compound selected from aliphatic diol and alicyclic diol in the presence of a catalyst, and the mass average molecular weight of the modified polyester resin is 10,000 to 100,000.

In the fourth embodiment, the toner of the present invention is obtained by emulsifying and/or dispersing a toner solution in an aqueous medium to prepare a dispersion liquid after dissolving and/or dispersing a toner material containing the active hydrogen-containing compound and the polymer capable of reacting with the active hydrogen-containing compound in an organic solvent to prepare the toner solution, and by reacting the active hydrogen-containing compound and a polymer capable of reacting with the active hydrogen-containing compound to generate an adhesive base material in form of particles. The polymer capable of reacting with the active hydrogen-containing compound is a modified polyester resin and the modified polyester resin is obtained by performing condensation polymerization of an acid component and at least one type of diol compound selected from aliphatic diol and alicyclic diol in the presence of a catalyst and the mass average molecular weight of the modified polyester resin is 10,000 to 100,000.

The each toner of the above first, second, third and fourth embodiments are capable of pursuing excellent low-temperature fixing property and offset resistance simultaneously to form appropriate images of high resolution.

DETAILED DESCRIPTION OF THE INVENTION (Toner)

Figure 1:
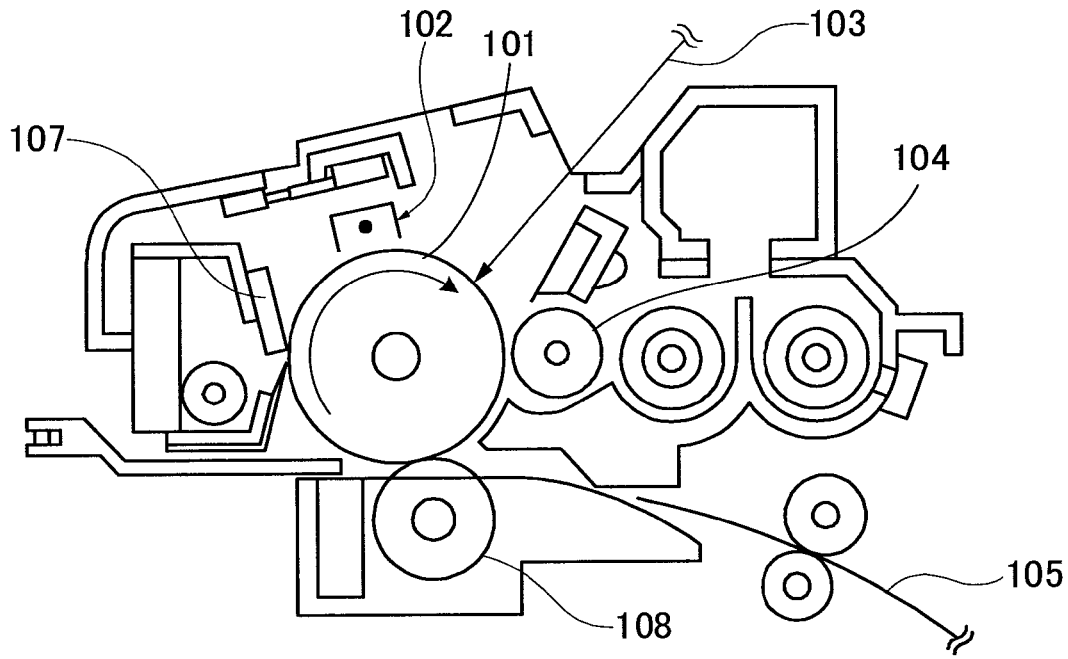
FIG. 1 is a schematic block diagram showing an exemplary process cartridge of the present invention.

In the first embodiment, the toner of the present invention at least contains binder resin and colorant, and the binder resin contains a resin which is obtained by cross-linking and/or elongating the primary modified polyester (B) derived from a precursor (A) which is polyester having an average molecular weight of 10,000 to 90,000 and preferably 10,000 to 50,000.

The average molecular weight of the primary modified polyester (B) is preferably 10,000 to 100,000.

The toner obtained by cross-linking the polyester (A) which has been used conventionally has a glass transition temperature near 70° C. and if the temperature of the fixing roller is decreased for use, the toner is not melted sufficiently resulting in insufficient fixing.

The polyester of higher molecular weight is used as the polyester (A) of the toner of the present invention which is used as a precursor of polymerization. This can lower the glass transition temperature near the lower limit of fixing temperature of the toner and allows having the glass transition temperature Tg which can maintain the hear-resistant storage property even in the region of hot offset generation temperature, contributing to further improvement of low-temperature fixing property and maintenance of heat-resistant storage property.

It is preferable to use polyester (A) having a glass transition temperature within the range of 30° C. to 50° C. and more preferably within the range of 30° C. to 40° C. as a precursor material of polymerization.

The glass transition temperature (Tg) is measured by means of Rigaku THRMOFLEX TG8110 manufactured by Rigaku Industrial Corp. with a rate of temperature rise of 10° C./min.

Furthermore, molecular weight is measured by GPC (gel permeation chromatography) as follows. A column is stabilized in a heat chamber of 40° C., THF is flown into the column maintaining this temperature at a current speed of 1 ml/min as a solvent and 50 μl to 200 μl of THF sample solution of resin which is adjusted to have a sample density of 0.05% by mass to 0.6% by mass is injected for measurement. As regard to the measurement of molecular weight of the sample, the molecular weight distribution of the sample was calculated from the relation between logarithm value of prepared standard curve using several types of monodisperse polystyrene standard sample and counted number. Examples of standard polystyrene sample for preparing standard curve include standard polystyrene samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ manufactured by Pressure Chemical Co. or Toyo Soda Co. Ltd. and it is appropriate to use at least about 10 standard polystyrene samples. And RI (refractive index) detector is used as a detector.

As regard to the thermal quality of the resin which can be obtained by cross-linking or elongating a unit material of polymerization, as the distance between cross-linking points increases, flexibility of the resin increases and the glass transition temperature (Tg) tend to be lowered.

By using polyester having an average molecular weight within the range of 10,000 to 90,000 as a precursor (A) which is a unit material of polymerization, it is possible to elongate the distance between cross-linking points of the resin as compared with the resin obtained by cross-linking the traditionally used polyester as well as to soften the properties of the resin.

Therefore, it is possible to lower the glass transition temperature (Tg) near the lower limit of fixing temperature of the toner and improve low-temperature fixing property. And furthermore, since viscoelasticity of the toner in the hot offset temperature region can be maintained at a constant level, it is possible to obtain a toner which can pursue low-temperature fixing property and hot offset resistance simultaneously.

The glass transition temperature of the toner is preferably in the range of 40° C. to 55° C.

When the glass transition temperature is less than 40° C., blocking of the toner or filming on the photoconductor in the developing apparatus is likely to occur and when the glass transition temperature is more than 55° C., low-temperature fixing property is likely to be degraded.

Since the toner of the present invention uses the above polyester (A) as a precursor material and has resins which contain the polyester (A) as a cross-linking unit, it is capable of having a glass transition temperature in the above range and combining low-temperature fixing property, heat-resistant storage property and high durability.

Meanwhile, the glass transition temperature of the toner can be measured similarly as the glass transition temperature of the polyester resin.

In the second and third embodiments, the toner of the present invention is granulated in an aqueous medium and contains at least ethyl acetate-soluble polyester component and ethyl acetate-insoluble polyester component and further contains other components as necessary.

The polyester component is said to be ethyl acetate-soluble, when a transmittance in visible light region is 99.5% or more when 0.5% by mass of the polyester resin component is dissolved in ethyl acetate and it is said to be ethyl acetate-insoluble, when the transmittance is less than 99.5%.

Meanwhile, the "primary modified prepolymer (B)" in the first embodiment corresponds to the "modified polyester" in the second and third embodiments and the "secondary modified polyester" in the first embodiment corresponds to the "ethyl acetate-insoluble polyester component" in the second and third embodiments.

In the fourth embodiment, the toner of the present invention contains an active hydrogen-containing compound and a polymer capable of reacting with the active hydrogen-containing compound and further contains other elements as necessary.

The ethyl acetate-insoluble polyester component contains modified polyester resin having a mass average molecular weight of 10,000 to 100,000, which is a precursor of the ethyl acetate-insoluble polyester component.

The polymer capable of reacting with active hydrogen-containing compound of the fourth embodiment is modified polyester resin having a mass average molecular weight of 10,000 to 100,000.

The modified polyester resin is obtained by performing condensation polymerization of acid component and at least one type of diol compound selected from aliphatic diol and alicyclic diol in the presence of a catalyst.

Examples of diol compound include 1,4-butanediol, propylene glycol, ethylene glycol, diethylene glycol, neopentyl glycol and 1,6-hexanediol. These may be used alone or in combination.

It is preferable to use at least one of terephthalic acid and isophthalic acid as the acid component.

The catalyst is preferably Ti catalyst and examples thereof include titanium tetrabutoxide.

The mixing ratio of the diol compound and the acid component at the time of polycondensation reaction is not particularly limited and may be adjusted accordingly. For example, equivalent ratio ([OH]/[COOH]) of hydroxyl group [OH] in the diol compound to carboxyl group [COOH] in the acid component is preferably 2/1 to 1/1, more preferably 1.5/1 to 1/1 and most preferably 1.3/1 to 1.02/1.

Particularly preferred example of modified polyester resins include isocyanate group-containing polyester prepolymer A.

The isocyanate group-containing polyester prepolymer A is not particularly limited and may be selected in accordance with a purpose. For example, an isocyanate group-containing polyester prepolymer A may be obtained by reacting a polyester resin, which is obtained by condensation polymerization which takes place in the presence of a catalyst between the acid component and at least one type of diol compound selected from aliphatic diol and alicyclic diol, with polyisocyanate (PIC).

The aforementioned polyisocyanate (PIC) is not particularly limited, and may be appropriately selected in accordance with a purpose. Examples of the polyisocyanate (PIC) are aliphatic polyisocyanate, alicyclic polyisocyanate, aromatic diisocyanate, aromatic aliphatic diisocyanate, isocyanurate, phenol derivative thereof, blocked products thereof with oxime, caprolactam, and the like.

Examples of the aliphatic polyisocyanate are tetramethylen diisocyanate, hexamethylen diisocyanate, 2,6-diisocyanate methyl caproate, octamethylene diisocyanate, decamethylene diisocianate, dodecamethylene diisocyanate, tetradecamethylene diisocyanate, trimethyl hexane diisocyanate, tetramethyl hexane diisocyanate, and the like. Examples of the alicyclic polyisocyanate are isophorone diisocyanate, cyclohexylmethane diisocyanate, and the like. Examples of aromatic diisocyanate are tolylene diisocyanate, diphenylmethane diisocyanate, 1,5-naphthylene diisocyanate, diphenylene-4,4'-diisocyanate, 4,4'-diisocyanato-3,3'-dimethyl diphenyl, 3-methyldiphenyl methane-4,4'-diisocyanate, diphenylether-4,4'-diisocyanate, and the like. Examples of the aromatic aliphatic diisocyanate are $\alpha,\alpha,\alpha',\alpha'$-tetramethyl xylylene diisocyanate, and the like. Examples of the isocyanurate are tris-isocyanatoalkyl-isocyanurate, tri-isocyanatocycroalkyl-isocyanurate, and the like.

These may be used alone or in combination.

At the time of reacting the polyisocyanate (PIC) and the polyester resin, a mixing ratio which is defined as an equivalent ratio [NCO]/[OH] of an isocyanate group [NCO] in the polyisocyanate (PIC) to a hydroxyl group [OH] in the polyester resin is preferably 5/1 to 1/1 in general, more preferably 4/1 to 1.2/1 and most preferably 3/1 to 1.5/1. In the case that the molar ratio of [NCO] in the ratio is more than 5, it is liable to degrade low-temperature fixing properties. In the case that the molar ratio of [NCO] is less than 1, it is liable to degrade offset resistance.

The polyisocyanate (PIC) content in the isocyanate group-containing polyester prepolymer (A) is not particularly limited, and may be appropriately selected in accordance with a purpose. It is preferably 0.5% by mass to 40% by mass, more preferably 1% by mass to 30% by mass and most preferably 2% mass to 20% by mass.

In the case that the content is less than 0.5% by mass, it is liable to degrade offset resistance and simultaneous pursuit of heat-resistant storage property and low-temperature fixing property may be difficult. In the case that the content is more than 40% by mass, it is liable to degrade low-temperature fixing properties.

The rate of content of isocyanate group in the modified polyester resin based on JIS K1603 is preferably 2.0% by mass and more preferably 1.0% by mass to 2.0% by mass. If the rate of content of the isocyanate group is more than 2.0% by mass, fixing performance at low temperatures may not be expressed.

The rate of content of isocyanate group (NCO %) can be measured by the method based on JIS K1603, for example.

The mass-average molecular weight of the modified polyester resin is preferably 10,000 to 100,000 and more preferably 10,000 to 50,000. If the mass-average molecular weight is less than 10,000, low-temperature fixing property may not be expressed and if the mass-average molecular weight is more than 100,000, granulation may be difficult due to too much viscosity.

The mass average molecular weight can be obtained from the measurement of molecular weight distribution by means of gel permeation chromatography (GPC) of tetrahydrofuran (THF)-soluble matter as follows.

At first, a column is set and secured in a heat chamber at the interior temperature of 40° C. While maintaining the same interior temperature, tetrahydrofuran (THF) as a column solvent is flown into the column at the flow velocity of 1 ml/min. To this flow, there is introduced 50 μl to 200 μl of a tetrahydrofuran solution of a resin sample wherein the resin sample concentration is adjusted to 0.05% by mass to 0.6% by mass. The resin sample is then measured. In the measurement, the molecular weight distribution of the resin sample is calculated from the relationship between the logarithm values of calibration curve prepared from several types of monodispersed polystyrene standard samples, and counting numbers. The standard-polyester samples for calibration are, for example, standard polyester samples each respectively having a molecular mass of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, all of which are commercially available from Pressure Chemical Co. or Toyo Soda Co. Ltd., and are preferably about 10 standard polyester samples. Note that a refractive index (RI) detector can be used as a detector in the above measurements.

The glass transition temperature (Tg) of the modified polyester resin is preferably 10° C. to 50° C. and more preferably 30° C. to 50° C.

The hydroxyl value of the modified polyester resin is preferably 30 mgKOH/g or less and more preferably 10 mgKOH/g to 25 mgKOH/g.

The acid value of the modified polyester resin is preferably 0 mgKOH/g to 10 mgKOH/g and more preferably 0 mgKOH/g to 5 mgKOH/g.

These acid values and hydroxyl values can be measured by the method specified in JIS K0070.

The modified polyester resin can be obtained by putting diol compound, acid component and titanium catalyst in a reaction vessel equipped with cooling tube, stirrer and nitrogen introducing tube, reacting at 230° C. under normal pressure for 8 hours and then reacting at reduced pressure of 10 mmHg to 15 mm Hg for 5 hours and further reacting with isocyanate group-containing compound.

It is preferable for the ethyl acetate-insoluble polyester component to have crosslinking point in the molecular chain in terms of hot offset resistance. And it is preferable for the ethyl acetate-insoluble polyester component to contain gel component in terms of hot offset resistance.

The gel component in here can be measured by Soxhlet extraction with organic solvents.

The toner material at least contains an adhesive base material, which can be obtained by reacting an active hydrogen-containing compound, modified polyester resin, which is a polymer capable of reacting with the active hydrogen-containing compound, and ethyl acetate-soluble polyester component, and releasing agent and colorant, and further contains other elements such as resin fine particles and charge controlling agent as necessary.

—Adhesive Base Material—

The adhesive base material exhibits adhesive property to a recording medium such as paper, at least contains an adhesive polymer resulted from a reaction in an aqueous medium between an active hydrogen group-containing compound, the modified polyester resin, which is a polymer capable of reacting with the active hydrogen group-containing compound, and ethyl acetate-soluble polyester component and may also contain binder resins which are appropriately selected from known binder resins.

The mass average molecular weight of the adhesive base material is not particularly limited and can be appropriately adjusted in accordance with a purpose. It is preferably 1,000 or more, more preferably 2,000 to 10,000,000 and most preferably 3,000 to 1,000,000. In the case that the mass average molecular weight of the adhesive base material is less than 1,000, it is liable to adversely affect on offset resistance.

—Active Hydrogen Group-Containing Compound—

The active hydrogen group-containing compound functions as an elongation initiator or crosslinking agent at the time of elongation reactions or crosslinking reactions of the active hydrogen group-containing compound and the polymer capable of reacting with the compound in an aqueous medium.

The active hydrogen group-containing compound is not particularly limited, provided that it contains an active hydrogen group, and may be appropriately selected in accordance with a purpose. In the case that the modified polyester resin, which is a polymer capable of reacting with the active hydrogen group-containing compound, is isocyanate group-containing polyester prepolymer (A), the active hydrogen group-containing compound is preferably selected from (B) amines because of the capability to increase molecular weight by elongation reaction, crosslinking reaction, and the like with the isocyanate group-containing polyester prepolymer (A).

The active hydrogen group is not particularly limited, and may be appropriately selected in accordance with a purpose. Examples of the active hydrogen group are hydroxyl groups such as an alcoholic hydroxyl group, a phenolic hydroxyl group, and the like, amino groups, carboxyl groups, mercapto groups, and the like, which can be used singly or in combination of two or more thereof. Of these, the alcoholic hydroxyl group is particularly preferable.

The (B) amines are not particularly limited, and can be appropriately selected in accordance with a purpose. Examples of (B) amines are (B1) a divalent amine compound, (B2) a trivalent or more polyvalent amine compound, (B3) an aminoalcohol, (B4) an amino mercaptan, (B5) an amino acid, and (B6) a compound in which the amino groups of B1 to B5 are blocked.

These can be used singly or in combination of two or more. Of these amines, the (B1) divalent amine compound, and a mixture of (B1) divalent amine compound and (B2) trivalent or more polyvalent amine compound are particularly preferable.

Examples of the (B1) divalent amine compound are: an aromatic diamine such as phenylene diamine, diethyl toluene diamine, 4,4'-diamino diphenyl methane; an alicyclic diamine such as 4,4'-diamino-3,3'-dimethyl dicyclohexyl methane, diamine cyclohexane, and isophorone diamine; and an aliphatic diamine such as ethylene diamine, tetramethylene diamine, and hexamethylene diamine.

Examples of the (B2) trivalent or more polyvalent amine compound are diethylene triamine, triethylene tetramine, and the like.

Examples of the (B3) aminoalcohol are ethanol amine, hydroxyethylaniline, and the like.

Examples of the (B4) amino mercaptan are aminoethyl mercaptan, aminopropyl mercaptan, and the like.

Examples of the (B5) amino acid are aminopropionic acid, aminocaproic acid, and the like.

Examples of the (B6) compound in which the amino groups of B1 to B5 are blocked are: a ketimine compound obtained from the above-noted amines of B1 to B5 and ketones such as acetone, methyl ethyl ketone, and methyl isobutyl ketone; oxazolidine compound; and the like.

In order to stop cross-linking and/or elongation reactions of the active hydrogen group-containing compound and the polymer capable of reacting with the active hydrogen group-containing compound, a reaction stopper may be used as required to control the molecular weight of the adhesive base material to be obtained. Examples of the reaction stopper are: a monoamine such as diethyl amine, dibutyl amine, butyl amine, and lauryl amine; a compound in which the above-noted elements are blocked such as a ketimine compound; and the like.

A mixing ratio of (B) amines and a isocyanate group-containing polyester prepolymer (A), defined as an equivalent ratio [NCO]/[NHx] of isocyanate group [NCO] in isocyanate group-containing polyester prepolymer (A) to amine group [NHx] in (B) amines, is preferably 1/3 to 3/1, more preferably 1/2 to 2/1 and most preferably 1/1.5 to 1.5/1. When [NCO]/[NHx] is less than ⅓, the low-temperature fixing properties may be degraded. When [NCO]/[NHx] is more than 3/1, on the other hand, the molecular weight of the urea-modified polyester becomes low, thereby degrading hot-offset resistance.

—Ethyl Acetate-Soluble Polyester Component—

The ethyl acetate-soluble polyester component is not particularly limited and may be selected accordingly and examples thereof include polycondensation of polyol (PO) and polycarboxylic acid (PC). The part of the ethyl acetate-soluble polyester component is preferably compatible with the ethyl acetate-insoluble polyester component, in other words, they have similar structures which are compatible to each other in terms of low-temperature fixing propery and hot offset resistance.

The mass average molecular weight (Mw) of the ethyl acetate-soluble polyester component based on the molecular weight distribution of tetrahydrofuran-soluble matter by GPC (gel permeation chromatography) is preferably 1,000 to 30,000 and more preferably 1,500 to 15,000. If the mass average molecular weight (Mw) is less than 1,000, the content of the components having a mass average molecular weight (Mw) of less than 1,000 as stated above, need to be 8% by mass to 28% by mass because heat-resistant storage property may be degraded. At the same time, if the mass average molecular weight (Mw) is more than 30,000, low-temperature fixing property may be degraded.

The normal glass transition temperature of the ethyl acetate-soluble polyester component is 30° C. to 70° C. and it is preferably 35° C. to 70° C., more preferably 35° C. to 50° C. and most preferably 35° C. to 45° C. When the glass transition temperature is less than 30° C., heat-resistant storage property of the toner may be degraded and when it is more than 70° C., low-temperature fixing property may be insufficient.

The acid value of the ethyl acetate-soluble polyester component is preferably 1.0 mgKOH/g to 50.0 mgKOH/g, more preferably 1.0 mgKOH/g to 45.0 mgKOH/g and most preferably 15.0 mgKOH/g to 45.0 mgKOH/g. Generally, by providing the toner an acid value, it is likely to be negatively charged.

When the ethyl acetate-soluble polyester component is contained in the toner, the fixing mass ratio of the ethyl acetate-insoluble polyester component to the ethyl acetate-soluble polyester component is preferably 5/95 to 25/75 and more preferably 10/90 to 25/75.

If the mixing mass ratio of the ethyl acetate-soluble polyester component is more than 95, hot offset resistance may be degraded and simultaneous pursuit of heat-resistant storage property and low-temperature fixing property may be difficult. If the mixing mass ratio is less than 25, luster may be degraded.

—Other Components—

The other components are not particularly limited, and may be appropriately selected in accordance with a purpose. The other components to be contained are, for example, colorants, releasing agents, charge controlling agents, fine inorganic particles, flowability improvers, cleaning improvers, magnetic materials, metal soaps, and the like.

The colorant is not particularly limited, and may be appropriately selected from the conventional dyes and pigments in accordance with a purpose. Examples of the colorant are carbon black, nigrosine dye, iron black, naphthol yellow S, Hansa yellow (10 G, 5 G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5 G, R), tartrazine lake yellow, quinoline yellow lake, anthrasane yellow BGL, isoindolinon yellow, colcothar, red lead, lead vermilion, cadmium red, cadmium mercury red, antimony vermilion, permanent red 4R, para red, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and the like. Theses may be used singly or in combination of two or more.

The colorant content of the toner is not particularly limited, and may be appropriately adjusted in accordance with a purpose. The colorant content is preferably 1% by mass to 15% by mass, and more preferably 3% by mass to 10% by mass.

In the case that the colorant content is less than 1% by mass, it is liable to lower tinting strength of the toner. In the case that the colorant content is more than 15% by mass, it is liable to adversely affect the dispersibility of the colorant in the toner particles, which results in lowering tinting strength and charging ability of the toner.

The colorant may be used as a master batch compounded with a resin. The resin for use is not particularly limited, and may be appropriately selected in accordance with a purpose. Examples of the binder resin in the master batch are styrene or substituted polymer thereof, styrene copolymer, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic hydrocarbon resin, alicyclic hydrocarbon resin, aromatic petroleum resin, chlorinated paraffin, paraffin, and the like. These may be used singly or in combination of two or more.

Examples of the styrene or substituted polymer thereof are polyester resin, polystyrene, poly-p-chlorostyrene, polyvinyl toluene, and the like. Examples of the styrene copolymer are styrene-p-chlorostyrene copolymer, styrene-propylene copolymer, styrene-vinyl toluene copolymer, styrene-vinyl naphthalene copolymer, styrene-methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-methyl-α-chloromethacylate copolymer, styrene-acrylonitril copolymer, styrene-vinylmethylketone copolymer, styrene-butadiene copolymer, styrene-isoprene copolymer, styrene-acrylonitrile-indene copolymer, styrene-maleic acid copolymer, styrene-maleic ester copolymer, and the like.

The master batch is prepared, for example, by mixing or kneading the resin for the master batch and the colorant at high shear force. During this process, it is preferable to add an organic solvent so as to enforce interaction between the colorant and the resin. In addition, flashing method is also preferable for preparing the master batch since the pigment can be employed in the form of wetcake without drying. In the flashing method, an aqueous paste of the pigment and water is mixed or kneaded together with the resin and the organic solvent, the colorant is gradually transferred into the resin, and then the water and organic solvent are removed. For the aforementioned mixing or kneading, high shear force dispersing device, such as three-roller mills and the like are suitably used.

The releasing agent is not particularly limited, and may be appropriately selected from the conventional releasing agents in accordance with a purpose, for example, preferably waxes and the like.

Examples of the wax are a carbonyl group-containing wax, polyolefin wax, long-chain hydrocarbon, and the like. Each of these can be employed singly or in combination of two or more. Of these examples, the carbonyl group-containing wax is preferable.

Examples of the carbonyl group-containing wax are polyalkanoic ester, polyalkanol ester, polyalkanoic acid amide, polyalkyl amide, dialkyl ketone, and the like. Examples of the polyalkanoic ester are carnauba wax, montan wax, trimethylolpropane tribehenate, pentaerythritol tetrabehenate, pentaerythritol diacetate dibehenate, glycerin tribehenate, octadecan-1,18-diol distearate, and the like. Examples of the polyalkanol ester are trimellitic acid tristearyl, distearyl maleate, and the like. Examples of the polyalkanoic acid amide are dibehenyl amide and the like. Examples of the polyalkyl amide are trimellitic acid tristearyl amide, and the like. Examples of the dialkyl ketone are distearyl ketone, and the like. Of these carbonyl group-containing waxes, the polyalkanoic ester is particularly preferable.

Examples of the polyolefin wax are polyethylene wax, polypropylene wax, and the like.

Examples of the long-chain hydrocarbon are paraffin wax, Sasol Wax, and the like.

The melting point of the releasing agent is not particularly limited, and may be appropriately selected in accordance with a purpose. It is preferably 40° C. to 160° C., more preferably 50° C. to 120° C., and further more preferably 60° C. to 90° C. In the case that the melting point is less than 40° C., it adversely affects heat-resistant storage property of the wax. In the case that the melting point is more than 160° C., it is liable to cause cold offset at a relatively low temperature at the time of fixing. The melt viscosity of the wax is preferably 5 cps to 1,000 cps, and more preferably 10 cps to 100 cps by a measurement at a temperature of 20° C. higher than the melting point of the wax. In the case that the melt viscosity is less than 5 cps, a releasing ability is liable to be insufficient. In the case that the melt viscosity is more than 1,000 cps, on the other hand, it may not improve hot-offset resistance and low-temperature fixing property.

The content of releasing agents in the toner is not particularly limited and can be appropriately selected in accordance with a purpose. The content of the releasing agent is preferably 0% by mass to 40% by mass and more preferably 3% by mass to 30% by mass. When the content is higher than 40% by mass, flowability of the toner may be degraded.

The charge controlling agent is not particularly limited, and may be appropriately selected from conventionally available ones in accordance with a purpose. The charge controlling agent is preferably formed of a material having a color close to transparent and/or white, as a colored charge controlling agent may change or adversely affect the color tone of the toner.

Examples of the charge controlling agent are triphenylmethane dye, molybdic acid chelate pigment, rhodamine dye, alkoxy amine, quaternary ammonium salt such as fluoride-modified quaternary ammonium salt, alkylamide, phosphoric simple substance or compound thereof, tungsten itself or compound thereof, fluoride activator, salicylic acid metallic salt, salicylic acid derivative metallic salt, and the like. These can be selected singly or in combination of two or more.

The charge controlling agent for use in the present invention is also selected from the commercially available products. Specific examples thereof are Bontron P-51 of a quaternary ammonium salt, Bontron E-82 of an oxynaphthoic acid metal complex, Bontron E-84 of a salicylic acid metal complex, and Bontron E-89 of a phenol condensate (by Orient Chemical Industries, Ltd.); TP-302 and TP-415 of a quaternary ammonium salt molybdenum complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.), quinacridone, azo pigment, and other high-molecular mass compounds having a functional group, such as sulfonic acid group, carboxyl group, and quaternary ammonium salt, and the like.

The charge controlling agent may be dissolved and/or dispersed in the toner material after kneading with the master batch. The charge controlling agent may also be added at the time of dissolving and/or dispersing in the organic solvent together with the toner material. In addition, the charge controlling agent may be fixed onto the surface of the toner particles after preparing the toner particles.

The content of the charge controlling agent in the toner is determined depending on the types of binder resins, presence or absence of additives, and dispersing methods and is not limited uniformly; preferably, to 100 parts by mass of binder resin, 0.1 part by mass to 10 parts by mass of the charge controlling agent is used and more preferably with 0.2 part by mass to 5 part by mass of the charge controlling agent. In the case that the content is less than 0.1 parts by mass, charge may not be appropriately controlled. In the case that the content of charge controlling agent is more than 10 parts by mass, charge ability of the toner become exceedingly large, which lessens the effect of the charge controlling agent itself and increases in electrostatic attraction force with a developing roller, and causes degradations of developer fluidity and image density.

—Resin Fine Particles—

The resin fine particles are not particularly limited, and the material thereof may be appropriately selected from the conventional resins in accordance with a purpose, provided that the resin is capable of forming aqueous dispersion in the aqueous phase. The resin fine particles may be formed of thermoplastic resin or thermosetting resin. Examples of the material of the resin fine particles are vinyl resin, polyurethane resin, epoxy resin, polyester resin, polyamide resin, polyimide resin, silicone resin, phenol resin, melamine resin, urea resin, anilline resin, ionomer resin, polycarbonate resin, and the like and among them, vinyl resin is particularly preferable. These can be selected singly or in combination of two or more, for use as the resin fine particles. Among these examples, the resin fine particles are preferably formed of one selected from the vinyl resin, polyurethane resin, epoxy resin, and polyester resin because aqueous dispersion of fine and spherical resin particles can be easily obtained.

The vinyl resin is a polymer in which vinyl monomer is mono- or co-polymerized. Examples of the vinyl resin are styrene-(meth)acrylic acid ester resin, styrene-butadiene copolymer, (meth)acrylic acid-acrylic acid ester copolymer, styrene-acrylonitrile copolymer, styrene-maleic anhydride copolymer, styrene-(meth)acrylic acid copolymer, and the like.

Moreover, the finer resin particles may be formed of copolymer containing a monomer having at least two or more unsaturated groups. The monomer having two or more unsaturated groups is not particularly limited, and may be selected in accordance with a purpose. Examples of such monomer are sodium salt of sulfuric acid ester of ethylene oxide adduct of methacrylic acid (Eleminol RS-30, by Sanyo Kasei Co., Ltd.), divinylbenzene, hexane-1,6-diol acrylate, and the like.

The resin fine particles are formed by polymerizing the above-listed monomers in accordance with a method appropriately selected from conventional methods. The resin fine particles are preferably obtained in the form of aqueous dispersion of the resin fine particles. Examples of preparation method of such aqueous dispersion are the following (1)-(8):

(1) a preparation method of aqueous dispersion of the resin fine particles, in which, in the case of the vinyl resin, a vinyl monomer as a starting material is polymerized by suspension-polymerization method, emulsification-polymerization method, seed polymerization method or dispersion-polymerization method;

(2) a preparation method of aqueous dispersion of the resin fine particles, in which, in the case of the polyaddition and/or condensation resin such as the polyester resin, the polyurethane resin, or the epoxy resin, a precursor (monomer, oligomer or the like) or solvent solution thereof is dispersed in an aqueous medium in the presence of a dispersing agent, and sequentially is heated or added with a curing agent so as to be cured, thereby obtaining the aqueous dispersion of the resin fine particles;

(3) a preparation method of aqueous dispersion of the resin fine particles, in which, in the case of the polyaddition and/or condensation resin such as the polyester resin, polyurethane resin, or epoxy resin, an arbitrary selected emulsifier is dissolved in a precursor (monomer, oligomer or the like) or solvent solution thereof (preferably being liquid, or being liquidized by heating), and then water is added thereto so that phase inversion emulsification is induced, thereby obtaining the aqueous dispersion of the resin fine particles;

(4) a preparation method of aqueous dispersion of the resin fine particles, in which a previously prepared resin by a polymerization method, which is any of addition polymerization, ring-opening polymerization, polyaddition, addition condensation or condensation polymerization, is pulverized by means of a pulverizing mill such as mechanical rotation-type, jet-type or the like, the thus obtained resin powder is classified to thereby obtain resin fine particles, and then the resin fine particles are dispersed in an aqueous medium in the presence of an arbitrary selected dispersing agent, thereby obtaining the aqueous dispersion of the resin fine particles;

(5) a preparation method of aqueous dispersion of the resin fine particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is sprayed in the form of mist to thereby obtain resin fine particles, and then the thus obtained resin fine particles are dispersed in an aqueous medium in the presence of an arbitrary selected dispersing agent, thereby obtaining the aqueous dispersion of the resin fine particles;

(6) a preparation method of aqueous dispersion of the resin fine particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is subjected to precipitation by adding with a poor solvent or cooling after heating and dissolving, the solvent is sequentially removed to thereby obtain resin fine particles, and then the thus obtained resin fine particles are dispersed in an aqueous medium in the presence of an arbitrary selected dispersing agent, thereby obtaining the aqueous dispersion of the resin fine particles;

(7) a preparation method of aqueous dispersion of the resin fine particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is dispersed in an aqueous medium in the presence of an arbitrary selected dispersing agent, and then the solvent is removed by heating or reduced pressure to thereby obtain the aqueous dispersion of the resin fine particles;

(8) a preparation method of aqueous dispersion of the resin fine particles, in which a previously prepared resin by a polymerization method, which is any of addition polymerization, ring-opening polymerization, polyaddition, addition condensation or condensation polymerization, is dissolved in a solvent to thereby obtain a resin solution, an arbitrary selected emulsifier is dissolved in the resin solution, and then water is added to the resin solution so that phase inversion emulsification is induced, thereby obtaining the aqueous dispersion of the resin fine particles.

Examples of toner include a toner which is produced by known methods such as suspension-polymerization method, emulsion-aggregation method, emulsion-dispersion method, and the like. The toner is preferably produced by dissolving the toner material containing an active hydrogen group-containing compound and the modified polyester resin, which is a polymer reactive with the compound, in an organic solvent to prepare a toner solution, dispersing the toner solution in an aqueous medium so as to form a dispersion, allowing the active hydrogen group-containing compound and the modified polyester resin, which is a polymer reactive with the compound, to react so as to form an adhesive base material in the form of particles, and removing the organic solvent.

—Toner Solution—

The toner solution is prepared by dissolving the toner material in an organic solvent.

—Organic Solvent—

The organic solvent is not particularly limited and may be selected accordingly, provided that the organic solvent allows the toner material to be dissolved and/or dispersed therein. It is preferable that the organic solvent is a volatile organic solvent having a boiling point of less than 150° C. in terms of easy removal from the solution or dispersion. Suitable examples thereof are toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, and the like. Among these solvents, toluene, xylene, benzene, methylene chloride, 1,2-dichloroethane, chloroform, carbon tetrachloride are preferable and furthermore, ethyl acetate is more preferable. These solvents may be used alone or in combination.

The used amount of organic solvent is not limited and may be adjusted accordingly. It is preferably 40 parts by mass to 300 parts by mass, more preferably 60 parts by mass to 140 parts by mass and most preferably 80 parts by mass to 120 parts by mass with respect to 100 parts by mass of the toner material.

—Dispersion—

The dispersion is prepared by dispersing toner solution in an aqueous medium.

When the toner solution is dispersed in an aqueous medium, a dispersing element (oilspot) of the toner solution is formed in the aqueous medium.

—Aqueous Medium—

The aqueous medium is not particularly limited and may be selected from known mediums such as water, water-miscible solvent, and a combination thereof. Of these, water is particularly preferable.

The water-miscible solvent is not particularly limited, provided that it is miscible with water, and examples thereof include alcohol, dimethylformamide, tetrahydrofuran, Cellsolves, lower ketones, and the like.

Examples of alcohol include methanol, isopropanol, ethylene glycol, and the like. Examples of lower ketones include acetone, methyl ethyl ketone, and the like.

These may be used alone or in combination.

It is preferable to disperse the toner solution in the aqueous medium while stirring.

The method for dispersion is not particularly limited and may be selected from known dispersers such as low-speed-shear disperser, high-speed-shear disperser, friction disperser, high-pressure-jet disperser, supersonic disperser, and the like. Of these, high-speed-shear disperser is preferable, because it is capable of controlling particle diameter of the dispersing element (oilspot) to be within a range of 2 μm to 20 μm.

When the high-speed shear disperser is used, conditions like rotating speed, dispersion time, dispersion temperature, and the like are not particularly limited and may be adjusted accordingly. The rotating frequency is preferably 1,000 rpm to 30,000 rpm and more preferably 5,000 rpm to 20,000 rpm. The dispersion time is preferably 0.1 minute to 5 minutes for batch method. The dispersion temperature is preferably 0° C. to 150° C. with applied pressure and more preferably 40° C. to 98° C. Generally speaking, the dispersion is more easily carried out at a high dispersing temperature.

An exemplary method for producing toner in which toner is produced by producing adhesive base material in form of particles is described below.

In the method in which toner is produced by producing adhesive base material in form of particles, a preparation of an aqueous medium phase, a preparation of toner solution, a preparation of dispersion, an addition of aqueous medium and others such as synthesis of the modified polyester resin (prepolymer) which is reactive with the active hydrogen group-containing compound or synthesis of the active hydrogen group-containing compound, and the like, for example are performed.

The preparation of aqueous medium phase may be, for example, done by dispersing resin fine particles in the aqueous medium. The amount of resin fine particles added to the aqueous medium is not limited and may be adjusted accordingly and it is preferably 0.5% by mass to 10% by mass, for example.

The preparation of toner solution may be done by dissolving and/or dispersing toner materials such as active hydrogen group-containing compound, the modified polyester resin which is a polymer reactive with the active hydrogen group-containing compound, colorant, releasing agent, charge controlling agent and the ethyl acetate-soluble polyester component, and the like in the organic solvent.

These toner materials except active hydrogen group-containing compound and the modified polyester resin (prepolymer) which is a polymer reactive with the active hydrogen group-containing compound may be added and blended in the aqueous medium when resin fine particles are being dispersed in the aqueous medium in the aqueous medium phase preparation, or they may be added into the aqueous medium phase together with toner solution when toner solution is being added into the aqueous medium phase.

The preparation of dispersion may be carried out by emulsifying and/or dispersing the previously prepared toner solution in the previously prepared aqueous medium phase. At the time of emulsifying and/or dispersing, the active hydrogen group-containing compound and the modified polyester resin which is a polymer reactive with the active hydrogen group-containing compound are subjected to elongation and/or cross-linking reaction, thereby forming the adhesive base material. The adhesive base material (e.g. the aforementioned urea-modified polyester) is formed, for example, by (1) emulsifying and/or dispersing the toner solution containing modified polyester resin which is a polymer reactive with the active hydrogen group-containing compound (e.g. isocyanate group-containing polyester prepolymer (A)) in the aqueous medium phase together with the active hydrogen group-containing compound (e.g. (B) amines) so as to form a dispersion, and then the active hydrogen group-containing compound and the polymer reactive with the compound are subjected to elongation and/or cross-linking reaction in the aqueous medium phase; (2) emulsifying and/or dispersing toner solution in the aqueous medium previously added with the active hydrogen group-containing compound to form a dispersion, and then the active hydrogen group-containing compound and the polymer reactive with the compound are subjected to elongation and/or cross-linking reaction in the aqueous medium phase; (3) after adding and mixing toner solution in the aqueous medium, the active hydrogen group-containing compound is sequentially added thereto so as to form a dispersion, and then the active hydrogen group-containing compound and the polymer reactive with the compound are subjected to elongation and/or cross-linking reaction at an interface of dispersed particles in the aqueous medium phase.

In the method (3), it should be noted that modified polyester resin is preferentially formed on the surface of forming toner particles, thus it is possible to generate concentration gradient in the toner particles.

Condition of reaction for forming adhesive base material by emulsifying and/or dispersing is not particularly limited and may be adjusted accordingly with a combination of active hydrogen group-containing compound and the modified polyester resin which is a polymer reactive with the active hydrogen group-containing compound. A suitable reaction time is preferably from 10 minutes to 40 hours and more preferably from 2 hours to 24 hours. A suitable reaction temperature is preferably from 0° C. to 150° C. and more preferably from 40° C. to 98° C.

A suitable method to stably form a dispersion containing the active hydrogen group-containing compound and the modified polyester resin which is a polymer reactive with the active hydrogen group-containing compound (e.g. the isocyanate group-containing polyester prepolymer (A)) in the aqueous medium phase is, for example, a method in which the toner solution, produced from toner materials such as the modified polyester resin which is a polymer reactive with the active hydrogen group-containing compound (e.g. the isocyanate group-containing polyester prepolymer (A)), colorant, releasing agent, charge controlling agent, ethyl acetate-soluble polyester component, and the like that are dissolved and/or dispersed in the organic solvent, is added in the aqueous medium phase and dispersed by shear force. The detail of the dispersion method is as described above.

In the course of preparing the dispersion liquid, a dispersant is preferably used accordingly in order to stabilize the dispersion element (oil droplets made of the toner solution) to obtain the predetermined shape of the dispersed particles, and to sharpen the particle diameter distribution of the dispersed particles. The dispersant is not particularly limited, and may be appropriately selected in accordance with a purpose. The examples of dispersants include surfactants, inorganic dispersants hardly soluble in water, polymeric protective colloid, and the like. These dispersants may be used alone or in combination. Among these dispersants, surfactants are preferable.

Examples of the surfactant are an anionic surfactant, a cationic surfactant, a nonionic surfactant, an ampholytic surfactant, and the like.

Examples of the anionic surfactant are alkylbenzene sulfonic acid salts, α-olefin sulfonic acid salts, ester phosphate, and the like. Among them, the anionic surfactant having a fluoroalkyl group is preferable. Examples of the anionic surfactant having a fluoroalkyl group are fluoroalkyl carboxylic acid having 2-10 carbon atoms or a metal salt thereof, disodium perfluorooctanesulfonylglutamate, sodium-3-{omega-fluoroalkyl ($C_6$ to $C_{11}$)oxy}-1-alkyl($C_3$ to $C_4$) sulfonate, sodium-3-{omega-fluoroalkanoyl($C_6$ to $C_8$)-N-ethylamino}-1-propanesulfonate, fluoroalkyl($C_{11}$ to $C_{20}$) carboxylic acid or a metal salt thereof, perfluoroalkyl($C_7$ to $C_{13}$) carboxylic acid or a metal salt thereof, perfluoroalkyl($C_4$ to $C_{12}$) sulfonic acid or a metal salt thereof, perfluorooctanesulfonic acid diethanol amide, N-propyl-N-(2-hydroxyethyl)perfluorooctanesulfone amide, perfluoroalkyl($C_6$ to $C_{10}$)sulfoneamidepropyltrimethylammonium salt, a salt of perfluoroalkyl ($C_6$ to $C_{10}$)-N-ethylsulfonyl glycin, monoperfluoroalkyl($C_6$ to $C_{16}$)ethylphosphoric acid ester, and the like. Examples of the commercially available surfactant having a fluoroalkyl group are: Surflon S-111, S-112 and S-113 (by Asahi Glass Co.); Frorard FC-93, FC-95, FC-98 and FC-129 (by Sumitomo 3M Ltd.); Unidyne DS-101 and DS-102 (by Daikin Industries, Ltd.); Megafac F-110, F-120, F-113, F-191, F-812 and F-833 (by Dainippon Ink and Chemicals, Inc.); ECTOP EF-102, 103, 104, 105, 112, 123A, 123B, 306A, 501, 201 and 204 (by Tohchem Products Co.); Futargent F-100 and F150 (by Neos Co.).

Examples of the cationic surfactant are amine salt, quaternary ammonium salt, and the like. Examples of the amine salt are alkyl amine salt, aminoalcohol fatty acid derivative, polyamine fatty acid derivative, imidazoline, and the like. Examples of the quaternary ammonium salt are alkyltrimethyl ammonium salt, dialkyldimethyl ammonium salt, alkyldimethyl benzyl ammonium salt, pyridinium salt, alkyl isoquinolinium salt, benzethonium chloride, and the like. Among them, preferable examples are primary, secondary or tertiary aliphatic amine acid having a fluoroalkyl group, aliphatic quaternary ammonium salt such as perfluoroalkyl($C_6$ to $C_{10}$)sulfoneamidepropyltrimethylammonium salt, benzalkonium salt, benzetonium chloride, pyridinium salt, imidazolinium salt, and the like. Specific examples of the commercially available product thereof are Surflon S-121 (by Asahi Glass Co.), Frorard FC-135 (by Sumitomo 3M Ltd.), Unidyne DS-202 (by Daikin Industries, Ltd.), Megafac F-150 and F-824 (by Dainippon Ink and Chemicals, Inc.), Ectop EF-132 (by Tohchem Products Co.), and Futargent F-300 (by Neos Co.).

Examples of the nonionic surfactant are fatty acid amide derivative, polyhydric alcohol derivative, and the like.

Examples of the ampholytic surfactant are alanine, dodecyldi(aminoethyl)glycin, di(octylaminoethyl)glycin, N-alkyl-N,N-dimethylammonium betaine, and the like.

Examples of the inorganic dispersant poorly soluble in water are tricalcium phosphate, calcium carbonate, titanium oxide, colloidal silica, hydroxyl apatite, and the like.

Examples of the polymeric protective colloid are acid, (meth)acryl monomer having a hydroxyl group, vinyl alcohol or ether thereof, ester of vinyl alcohol and a compound having a carboxyl group, amide compound or methylol compound thereof, chloride, monopolymer or copolymer having a nitrogen atom or heterocyclic ring thereof, polyoxyethylene, cellulose, and the like.

Examples of the acid are acrylic acid, methacrylic acid, α-cyanoacrylic acid, α-cyanomethacrylic acid, itaconic acid, crotonic acid, fumaric acid, maleic acid, maleic anhydride, and the like. Examples of the (meth)acryl monomer having a hydroxyl group are β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic ester, diethyleneglycol monomethacrylic ester, glycerin monoacrylic ester, glycerin monomethacrylic ester, N-methylol acrylamido, N-methylol methacrylamide, and the like. Examples of the vinyl alcohol or ether thereof are vinyl methyl ether, vinyl ethyl ether, vinyl propyl ether, and the like. Examples of the ester of vinyl alcohol and a compound having a carboxyl group are vinyl acetate, vinyl propionate, vinyl butyrate, and the like. Examples of the amide compound or methylol compound thereof are acryl amide, methacryl amide, diacetone acrylic amide acid, or methylol thereof, and the like. Examples of the chloride are acrylic chloride, methacrylic chloride, and the like. Examples of the monopolymer or copolymer having a nitrogen atom or heterocyclic ring thereof are vinyl pyridine, vinyl pyrrolidone, vinyl imidazole, ethylene imine, and the like. Examples of the polyoxyethylene are polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenyl ester, polyoxyethylene nonylphenyl ester, and the like. Examples of the cellulose are methyl cellulose, hydroxyethyl cellulose, hydroxypropyl cellulose, and the like.

In the preparation of the dispersion, a dispersing stabilizer is employed, if necessary. The dispersing stabilizer is, for example, acid such as calcium phosphate, alkali-soluble compound, or the like.

In the case that the dispersing stabilizer is employed, the dispersing stabilizer is dissolved by acid such as hydrochloric acid, and then is washed with water or decomposed by a enzyme, thereby being removed from fine particles.

In the preparation of the dispersion, a catalyst for the elongation and/or crosslinking reaction is employed, if necessary. The catalyst is, for example, dibutyltin laurate, dioctyltin laurate, and the like.

The removal of the organic solvent from the obtained dispersion (emulsified slurry) is carried out, for example, by the following methods (1)-(2):

(1) the temperature of the dispersion is gradually increased, and the organic solvent in the oil droplets are completely evaporated and removed;

(2) the emulsified dispersion is sprayed in a dry atmosphere, the water-insoluble organic solvent is completely evaporated and removed from the oil droplets to form toner fine particles, and the aqueous dispersant is evaporated and removed.

Once the organic solvent is removed, toner particles are formed. The toner particles may be washed and dried and then classified as necessary. The classification is, for example, carried out by cyclone, decanter, or centrifugal separation in the solution. Alternatively, the classification is carried out after the toner particles are obtained as powder by drying.

The thus obtained toner particles are subjected to mixing with particles such as the colorant, the releasing agent, the charge controlling agent, etc., and mechanical impact, thereby preventing the particles such as the releasing agent falling off from the surface of the toner particles.

Examples of the method of imparting mechanical impact are a method in which an impact is imparted by rotating a blade at high speed, and a method in which an impact is imparted by introducing the mixed particles into a high-speed flow and accelerating the speed of the flow so as to make the particles to crash with each other or so as to make the composite particles to crash upon an impact board. Examples of a device employed to such method are an angmill (by Hosokawamicron Corp.), a modified I-type mill (by Nippon Pneumatic Mfg. Co., Ltd.) to decrease pulverization air pressure, a hybridization system (by Nara Machinery Co., Ltd.), a kryptron system (by Kawasaki Heavy Industries, Ltd.), an automatic mortar, and the like.

The toner preferably has the following average circularity, volume average particle diameter (Dv), a ratio (Dv/Dn) of volume average particle diameter (Dv) to number average particle diameter (Dn), glass transition temperature (Tg) and shape factors, SF-1 and SF-2.

The average circularity of the toner is preferably 0.90 to 0.97. The average circularity SR is defined by SR=(circumference of a circle which has the same area as the particle projected area/boundary length of particle projected image)× 100% and as the toner gets close to a sphere, the degree of circularity comes close to 100%. The toner with high circularity tends to be affected by developing electrical field and is developed precisely based on the electrical field of a latent electrostatic image.

Therefore, it is possible to form images of high resolution with appropriate image density and excellent reproducibility. If the average circularity is less than 0.90, it is difficult to obtain high quality images with satisfactory transfer property and no dust.

The average circularity of the toner may be measured by means of flow-type particle image analyzer FPIA-2000 (by Sysmex Corp.) as follows. First, 0.1 ml to 0.5 ml of a surfactant, preferably alkylbenzene sulfonate, as a dispersant is added to 100 ml to 150 ml of water from which impurities are previously removed in a container and approximately 0.1 g to 0.5 g of a measuring sample is added. The suspension in which the sample is dispersed is subject to dispersion using an ultrasonic dispersing devise for approximately one to three minutes to a dispersion concentration of 3,000 particles/μl to 10,000 particles/μl. The shape and distribution of toner particles can be measured using the aforementioned flow-type particle image analyzer.

The volume average particle diameter (Dv) of the toner is preferably 3 μm to 8 μm, more preferably 4 μm to 7 μm and most preferably 5 μm to 6 μm. The volume average particle diameter is defined here by $Dv=[(\Sigma(nD^3)/\Sigma n]^{1/3}$ where "n" represents number of the particles and "D" represents particle diameter.

In the case that the volume average particle diameter is less than 3 μm, the toner of two-component developer is liable to fuse onto carrier surfaces as a result of stirring in the developing unit for a long period and the charging ability of the carrier may be degraded. The single component developer is liable to cause a filming of the toner on a developing roller or fusion to a member such as a blade because of thinning of the toner layer. In the case that the volume average particle diameter is more than 8 μm, an image of high resolution and high quality is rarely obtained, and the average toner particle diameter is liable to fluctuate when a toner is repeatedly added to the developer to compensate the consumed toner.

The ratio (Dv/Dn) of the volume average particle diameter (Dv) to the number average particle diameter (Dn) is preferably 1.25 or less and more preferably 1.05 to 1.25.

Generally, it is said to be advantageous for obtaining images of high resolution and quality as the particle diameter of the toner gets smaller, but adversely, it is disadvantageous for transfer and cleaning properties.

If the volume average particle diameter is smaller than the range of the present invention, the toner of a two-component developer is liable to fuse onto carrier surfaces due to stirring in a developing unit for a long-term, thereby degrading a charging ability of the carrier, and a single component developer is liable to cause a filming on a developing roller or fusion to a member such as a blade for reducing a thickness of a toner layer formed onto a developing roller. And these phenomena are the same for the toners having rate of content of fine powder larger than the range of the present invention. If the particle diameter of the toner is larger than the range of the present invention, an image of high resolution and high quality is rarely obtained, and the average toner particle diameter is liable to fluctuate when a toner is repeatedly added to the developer to compensate the consumed toner. And the same thing applies to the case when the ratio of the volume average particle diameter to number average particle diameter is more than 1.25.

At the same time, when the ratio (Dv/Dn) of volume-average particle diameter to number-average particle diameter is less than 1.05, it may be favorable in terms of stability of toner behavior and uniformly charged amount, however, electrification of the toner may be insufficient and cleaning ability may be degraded.

The volume average particle diameter Dv and the ratio of the volume average particle diameter to the number average particle diameter (Dv/Dn) are measured, for example, by means of a particle diameter analyzer, Coulter Counter TAII manufactured by Beckmann Coulter Inc. with an aperture diameter of 100 μm and conducting an observational study using an analysis software, Beckman Coulter Multisizer 3 Version 3.51.

The glass transition temperature of the toner is preferably 40° C. to 70° C. If the glass transition temperature is less than 40° C., it is liable to degrade heat-resistant storage property of the toner. If the glass transition temperature is more than 70° C., it is liable to degrade low-temperature fixing property.

The glass transition temperature of the toner may be measured by means of TG-DSC system, TAS 100 manufactured by Rigaku Industrial Corp.

(Shape Factors SF-1 and SF-2)

The toner of the present invention preferably has a shape factor SF-1 in the range of 100 to 180 and a shape factor SF-2 in the range of 100 to 180. The SF-1 is more preferably 110 to 170, still more preferably 120 to 160 and most preferably 130 to 150. The SF-2 is more preferably 110 to 170, still more preferably 120 to 160 and most preferably 130 to 150.

The shape factors SF-1 and SF-2 are expressed by the following Equations (1) and (2).

$$SF\text{-}1=\{(MXLNG)^2/\mathrm{AREA}\}\times(100\pi/4) \quad \text{Equation (1)}$$

$$SF\text{-}2=\{(PERI)^2/\mathrm{AREA}\}\times(100\pi/4) \quad \text{Equation (2)}$$

When the value of SF-1 is 100, the shape of the toner is sphere, and as the value of SF-1 increases, the shape of the toner becomes more indefinite. And when the value of SF-2 is 100, no concaves and convexes exist on the toner surface and as the value of SF-2 increases, concaves and convexes on the toner surface become noticeable.

The shape factor SF-1 is a calculated value from the Equation (1) based on an analysis conducted by randomly sampling 100 toner particle images which are enlarged by 500 magnifications using an electron microscope such as FE-SEM (S-800) manufactured by Hitachi, Ltd. and adopting the image information in an image analyzing apparatus such as nexus NEW CUBE ver. 2.5 manufactured by Nexus and Luzex III manufactured by Nireco Corp. through interface.

The shape factor SF-2 is a calculated value from the Equation (2) based on an analysis conducted by randomly sampling 50 toner particle images enlarged by 3,500 magnifications using an electron microscope and adopting the image information in an image analyzing apparatus through interface.

When both of the shape factors SF-1 and SF-2 are close to 100 and the shape of the toner is near sphere, contacts between toners or toners and image bearing members becomes point contacts and the transfer ratio increases because absorbing power between toners weakens, resulting in an increase of flowability, and adhesive power between toners and image bearing members also weakens. Reproducibility of dots also becomes appropriate. At the same time, cleaning margin increases with the shape factors of the toner, SF-1 and SF-2 being large to some extent and flaws such as cleaning defects are prevented. Therefore, with both in mind, the shape factors SF-1 and SF-2 are preferably in the range of 100 to 180 where image quality levels are not degraded.

The coloration of the toner is not particularly limited and may be selected accordingly. For example, the coloration is at least one selected from black toner, cyan toner, magenta toner and yellow toner. Each color toner is obtained by appropriately selecting the colorant to be contained therein. It is preferably a color toner.

(Developer)

The developer contains at least the toner of the present invention and contains other elements such as carriers selected accordingly. The developer may be single component developer or two-component developer and it is preferably the two-component developer in terms of improving duration of life when the developer is used for high-speed printers which correspond to recent improvement of information processing speed.

In the case of single component developer using the toner, even if addition and reduction of the toner take place, it has less fluctuation in particle diameter of the toner, has no filming of the toner on the development roller and fusion of the toner to the members such as blade for thinning of the toner and development property and images which are appropriate and stable even for long-term use (stirring) of the development unit can be obtained. Moreover, in the case of the two-component developer using the toner of the present invention, even if addition and reduction of the toner take place, it has less fluctuation in particle diameter of the toner in the developer, and development property which is appropriate and stable even for long-term stirring in the developing unit can be obtained.

The carrier is not particularly limited and may be selected accordingly and it is preferably the carrier having core material and resin layer applied to the core material.

The material of the core material is not particularly limited and may be selected from known core materials. For example, it is preferably manganese-strontium (Mn—Sr) material of 50 emu/g to 90 emu/g and manganese-magnesium (Mn—Mg) material and preferably high magnetization material such as iron powder (100 emu/g or more) and magnetite (75 emu/g to 120 emu/g) in terms of securing image density. Moreover, it is preferably a low magnetization material such as copper-zinc (Cu—Zn) of 30 emu/g to 80 emu/g because the impact toward the photoconductor, in which the toner is being a magnetic brush can be softened and it is advantageous for higher image quality. These may be used alone or in combination.

The volume average particle diameter ($D_{50}$) of the core material is preferably 10 μm to 200 μm and more preferably 40 μm to 100 μm.

When the average particle diameter (volume average particle diameter ($D_{50}$)) is less than 10 μm, the amount of fine powder in the carrier particle size distribution increases whereas magnetization per particle decreases resulting in the carrier scattering. When the average particle diameter is more than 200 μm, the specific surface area decreases and causes carrier scattering. Therefore, for a full-color image having many solid parts, reproduction of the solid parts in particular may be insufficient.

The material of the resin layer is not particularly limited and may be selected from known resins accordingly. Examples include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoroterpolymer such as terpolymer of tetrafluoroethylene, vinylidene fluoride and non-fluoro monomer and silicone resin. These may be used alone or in combination.

Examples of amino resin include urea-formaldehyde resin, melamine resin, benzoguanamine resin, urea resin, polyamide resin, epoxy resin, and the like. Examples of polyvinyl resin include acrylic resin, polymethylmetacrylate resin, polyacrylonitrile resin, polyvinyl acetate resin, polyvinyl alcohol resin, polyvinyl butyral resin, and the like. Examples of polystyrene resin include polystyrene resin, styrene-acrylic copolymer resin, and the like. Examples of halogenated olefin resin include polyvinyl chloride, and the like. Examples of polyester resin include polyethyleneterephthalate resin and polybutyleneterephthalate resin, and the like.

The resin layer may contain conductive powder as necessary and examples of the conductive powder include metal powder, carbon black, titanic oxide, tin oxide, zinc oxide, and the like. The average particle diameter of these conductive powders is preferably 1 μm or less. If the average particle diameter is more than 1 μm, it may be difficult to control electrical resistance.

The resin layer may be formed by uniformly coating the surface of the core material with a coating solution, which is prepared by dissolving silicone resins, etc. in a solvent, by known coating method, and baking after drying. The examples of the coating method include dipping, spraying and brushing.

The solvent is not particularly limited and may be selected accordingly and examples include toluene, xylene, methyl ethyl ketone, methyl isobutyl ketone, cellosolve and butyl acetate.

The baking is not particularly limited and may be external heating or internal heating and examples include methods using fixed electric furnace, fluid electric furnace, rotary electric furnace, burner furnace and methods using microwaves.

The amount of the resin layers in the carrier is preferably 0.01% by mass to 5.0% by mass.

When the amount is less than 0.01% by mass, the resin layer may not be formed uniformly on the surface of the core material and when the amount is more than 5.0% by mass, the resin layer becomes too thick and granulation between carriers occur and uniform carrier particles may not be obtained.

If the developer is a two-component developer, the carrier content in the two-component developer is not particularly limited and may be selected accordingly and it is preferably 90% by mass to 98% by mass and more preferably 93% by mass to 97% by mass.

With regard to the mixing ratio of toner and carrier of the two-component developer, the toner is 1 part by mass to 10.0 parts by mass relative to 100 parts by mass of the carrier in general.

The developer of the present invention containing the toner of the present invention prevents occurrence of photoconductor filming, exhibits no fluctuation in image irregularity and can form clear and high quality images stably.

The developer of the present invention can be preferably used in forming images by known, various electrophotographic techniques such as magnetic single component developing, non-magnetic single component developing and two-component developing. In particular, the developer can be preferably used in the toner container, process cartridge, image forming apparatus, and the image forming method of the present invention below.

(Toner Container)

The toner container contains the toner and/or the developer of the present invention in the container.

The container is not particularly limited and can be appropriately selected from known containers. Preferable examples of the container include one having a toner container body and a cap.

The toner container body is not particularly limited in size, shape, structure, and material and can be appropriately selected in accordance with a purpose. The shape is preferably a cylinder. It is particularly preferable that a spiral ridge is formed on the inner surface; thereby the content or the toner moves toward the discharging end when rotated and the spiral part partly or entirely serves as a bellows.

The material of the toner container body is not particularly limited and preferably offers dimensional accuracy. For example, resins are preferable. Among them, polyester resin, polyethylene resin, polypropylene resin, polystyrene resin, polyvinyl chloride resin, polyacrylic acid, polycarbonate resin, ABS resin, polyacetal resin are preferable.

The toner container is easy to preserve and ship, is handy, and is preferably used with the process cartridge and image forming apparatus of the present invention, which are described later, by detachably mounting therein for supplying toner.

(Process Cartridge)

The process cartridge contains a latent electrostatic image bearing member which is configured to bear a latent electrostatic image thereon, and a developing unit which is configured to develop the latent electrostatic image on the latent electrostatic image bearing member with a developer to form a visible image. The process cartridge further contains other units such as charging unit, transfer unit, cleaning unit and charge removing unit as necessary.

The developing unit has a developer storage for storing the aforementioned toner and/or developer of the present invention and a developer bearing member which is configured to hold and transfer the toner and/or developer stored in the developer storage and may further have a layer thickness control member for controlling the thickness of a toner layer formed on the developer bearing member.

The process cartridge can be detachably mounted in a variety of electrophotographic apparatuses, facsimiles and printers and preferably detachably mounted in the image forming apparatus of the present invention, which will be described later.

The process cartridge contains, for example as shown in FIG. 1, built-in photoconductor 101, charging unit 102, developing unit 104 and cleaning unit 107 and, where necessary, further contains other members. In FIG. 1 also shown is the exposure 103 by means of an exposure unit. The recording medium 105 and transfer unit 108 are also shown. The latent electrostatic image bearing member which will be described later can be favorably used in photoconductor 101.

The charging unit 102 can be any charging member.

Next, the image forming process by means of the process cartridge as shown in FIG. 1 will be described. A latent electrostatic image corresponding to an exposed image is formed on the photoconductor 101 which is being rotated in an arrow direction by charging using the charging unit 102 and exposing using exposure 103 of exposure unit (not shown). The latent electrostatic image is developed using the toner by means of the developing unit 104, the toner image is then transferred to the recording medium 105 by means of the transfer unit 108 and printed out. The surface of the photoconductor after image transfer is cleaned by means of the cleaning unit 107 and the charge is further removed by means of a charge removing unit (not shown) and the above operations are repeated again.

The image forming apparatus of the invention may be constructed as a process cartridge unit containing latent electrostatic image bearing member, developing unit and cleaning unit, etc. placed onto the main body as detachable. Alternatively, a process cartridge unit containing a latent electrostatic image bearing member and at least one selected from charger, image exposing machine, developing unit, transfer or separation unit and cleaning unit may be constructed and placed onto the main body of image forming apparatus as a detachable single unit and this may be done by employing guidance unit such as main body rails, etc.

(Image Forming Apparatus and Image Forming Method)

The image forming apparatus of the present invention at least contains a latent electrostatic image bearing member, latent electrostatic image forming unit, developing unit and transfer unit and further contains other units as necessary and examples include charge removing unit, cleaning unit, recycling unit and control unit.

The image forming method of the present invention at least contains latent electrostatic image forming, developing, transferring and fixing, and further contains other steps as necessary and examples include charge removing, cleaning, recycling and controlling.

The image forming method of the present invention can be favorably performed by the image forming apparatus of the present invention, the latent electrostatic image forming can be performed by the latent electrostatic image forming unit, the developing can be performed by the developing unit, the transferring can be performed by the transfer unit, the fixing can be performed by the fixing unit and the other steps can be performed by the other units.

—Latent Electrostatic Image Forming and Latent Electrostatic Image Forming Unit—

The latent electrostatic image forming is a step that forms a latent electrostatic image on the latent electrostatic image bearing member.

Materials, shapes, structures or sizes, etc. of the latent electrostatic image bearing member (which may be referred to as "photoconductive insulator", "electrophotographic photoconductor" and "photoconductor") are not limited and may be selected accordingly and it is preferably drum-shaped. The materials thereof are, for example, inorganic photoconductors such as amorphous silicon and selenium; organic photoconductors such as polysilane, phthalopolymethine, and the like. Of these examples, amorphous silicon is preferred for its longer operating life.

For the amorphous silicon photoconductor, a photoconductor, (hereafter may be referred to as "a-Si series photoconductor") having a photo-conductive layer made of a-Si that is formed on the support by coating method such as vacuum deposition, sputtering, ion-plating, thermo-CVD, photo-CVD, plasma-CVD, and the like, while support is being heated at 50° C. to 400° C., may be used. Of these coating methods, plasma-CVD, whereby a-Si cumulo-layer is formed on the support by decomposition of the material gas by direct current, high-frequency wave or microwave glow discharge, is preferable.

The latent electrostatic image formation is carried out, for example, by exposing the latent electrostatic image bearing member to imagewise right after uniformly charging the entire surface of the latent electrostatic image bearing member. This is performed by means of the latent electrostatic image forming unit.

The latent electrostatic image forming unit contains at least a charging unit which is configured to uniformly charge the surface of the latent electrostatic image bearing member, and an exposure unit which is configured to expose the surface of the latent electrostatic image bearing member to imagewise light.

The charging is carried out, for example, by applying voltage to the surface of the photoconductor by means of the charging unit. The charging unit is not particularly limited, and may be appropriately selected in accordance with a purpose. Examples of the charging unit are the conventional contact-charging unit equipped with a conductive or semi-conductive roller, blush, film, or rubber blade, the conventional non-contact-charging unit utilizing corona discharge such as corotron, or scorotoron, and the like.

The form of the charging member may be in any embodiment other than rollers, such as magnetic brush, fir brush, etc. and may be selected corresponding to specifications and embodiments of electrophotographic apparatus. The magnetic brush uses various ferrite particles such as Zn—Cu ferrite as charging members and is made of nonmagnetic conductive sleeve which supports the charging member and magnet roll included in the nonmagnetic conductive sleeve. Firs processed with conductive treatment by means of carbon, copper sulfide, metal or metal oxide, for example may be used as material of the fir brush and the metals or firs are twisted or attached around other cored bars which are processed with conductive treatment to use as a charging unit.

The charging unit is not limited to above-mentioned contact types; however, it is preferably a contact type because it is possible to obtain an image forming method of which ozone generated from the charging unit is reduced.

The exposure is carried out, for example, by exposing the surface of the photoconductor to imagewise light by means of the exposure unit.

The exposure unit is not particularly limited, provided that a predetermined exposure is performed imagewise on the surface of the charged latent electrostatic image bearing member by the charging unit, and may be appropriately selected in accordance with a purpose. Examples of the exposure unit are various exposure units such as an optical copy unit, a rod-lens-array unit, an optical laser unit, an optical liquid crystal shatter unit, and the like.

In the present invention, a backlight system may be applied for the exposure, in which exposure is carried out imagewise from the back side of the photoconductor.

—Developing and Developing Unit—

The developing is a step to form a visible image by developing the latent electrostatic image using the toner and/or the developer of the present invention.

The toner image formation may be performed by developing the latent electrostatic image using the toner and/or developer by means of the developing unit. The developing unit is not particularly limited and may be selected from known developing unit accordingly as long as it can perform developing using the toner and/or the developer. Preferred examples include a developing unit containing the toner and/or the developer, and at least developing equipment which can provide the toner and/or the developer to the latent electrostatic image by contact or without contact. The developing equipment which is equipped with the toner container of the present invention is preferable.

The developing equipment may be of dry development type or wet development type and may be developing equipment for single color or multicolor and preferred examples include developing equipment which has a stirrer which charges the toner and/or developer by friction stirring, and rotatable magnet roller.

In the developing equipment, the toner and the carrier are stir mixed to charge the toner with the friction and retain the toner in a condition of magnetic brush on the surface of rotating magnet roller. Since the magnet roller is positioned near the latent electrostatic image bearing member (photoconductor), part of the toner constructing the magnetic brush formed on the surface of the magnet roller moves to the surface of the latent electrostatic image bearing member (photoconductor) by electric attraction. As a result, the latent electrostatic image is developed by the toner to form a visible image by the toner on the surface of the latent electrostatic image bearing member (photoconductor).

The developer contained in the developing equipment is the developer containing the toner of the present invention and may be single component developer or two-component developer. The toner contained in the developer is the toner of the present invention.

—Transferring and Transfer Unit—

The transferring is a step to transfer the visible image to a recording medium and it is preferably an embodiment using intermediate transfer member in which a visible image is transferred primarily on the intermediate transfer member and then the visible image is transferred secondarily to the recording medium. And it is more preferably an embodiment using the toner of two or more colors or preferably full-color toner and containing a primary transferring step in which a visible image is transferred to the intermediate transfer member to form a compound transfer image and a secondary transferring step in which the compound transfer image is transferred to a recording medium.

The transferring of the visible image may be performed by charging the latent electrostatic image bearing member (photoconductor) by means of transfer charging equipment and by the transfer unit. The preferred embodiment of the transfer unit contains primary transfer unit in which a visible image is transferred to the intermediate transfer member to form a compound transfer image and secondary transfer unit in which the compound transfer image is transferred to a recording medium.

The intermediate transfer member is not particularly limited and may be selected from known transfer member accordingly and examples include transfer belt and transfer roller, etc.

The stationary friction coefficient of intermediate transfer member is preferably 0.1 to 0.6 and more preferably 0.3 to 0.5. The volume resistance of intermediate transfer member is preferably more than several Ωcm or more and $10^3$ Ωcm or less. By keeping the volume resistance within a range of several Ωcm to $10^3$ Ωcm, the charging of the intermediate transfer member itself can be prevented and the charge given by the charging unit is unlikely to remain on the intermediate transfer member. Therefore uneven transfer at the time of secondary transferring can be prevented and the application of transfer bias at the time of secondary transferring becomes relatively easy.

The material of the intermediate transfer member is not particularly limited and may be selected from known materials accordingly. Preferred examples are as follows.

(1) A material of high Young's modulus (modulus of elongation) used as a single-layer belt such as PC (polycarbonate), PVDF (polyvinylidene fluoride), PAT (polyalkylene terephthalate), blended material of PC (polycarbonate) and PAT (polyalkylene terephthalate), blended material of ETFE (ethylenetetrafluoroethylene copolymer) and PC, blended material of ETFE and PAT, blended material of PC and PAT and heat-curable polyimide with carbon black dispersion. These single-layer belts of high Young's modulus have less deformation volume relative to the stress during image forming and have advantage of hardly having registration misalignment during color image forming in particular.

(2) A belt of two to three-layer compositions having the belt of high Young's modulus as a base layer and a surface layer or intermediate layer is provided on its periphery. These belts of two to three-layer compositions have a function to prevent dropouts of line images which are caused by hardness of the single-layer belt.

(3) A belt using rubber or elastomer with relatively low Young's modulus which has an advantage of hardly having dropouts of line images due to its softness. Moreover, since belt width is wider than activation roll and extended roll and meandering is prevented by using elasticity of the side of the belt which is prominent more than the rollers, it does not require alignment ribs or meandering-preventing devices contributing to cost reduction.

Among them, the elastic belt of (3) is especially preferable.

The elastic belts deform corresponding to the surface roughness of toner layers and the recording medium having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no letter drop outs even with a recording medium of low flatness.

The resins used for the elastic belts are not particularly limited and may be selected accordingly. Examples thereof include polycarbonate resins, fluorine resins (ETFE, PVDF), styrene resins (homopolymers and copolymers including styrene or substituted styrene) such as polystyrene resin, chloropolystyrene resin, poly-α-methylstyrene resin, styrene-butadiene copolymer, styrene-vinyl chloride copolymer, styrene-vinyl acetate copolymer, styrene-maleic acid copolymer, styrene-acrylic ester copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylic ester copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylic ester copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene resin, polypropylene resin, polybutadiene, polyvinylidene chloride resin, ionomer resin, polyurethane resin, silicone resin, ketone resin, ethylene-ethylacrylate copolymer, xylene resin and polyvinylbutylal resin, polyamide resin, modified polyphenylene oxide resin, and the like. These may be used alone or in combination.

The rubbers used for the elastic belts are not particularly limited and may be selected accordingly. Examples thereof include natural rubber, butyl rubber, fluorine rubber, acrylic rubber, EPDM rubber, NBR rubber, acrylonitrile-butadiene-styrene rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, and the like. These may be used alone or in combination.

The elastomers used for the elastic belts are not particularly limited and may be selected accordingly. Examples thereof include polystyrene thermoplastic elastomers, polyolefin thermoplastic elastomers, polyvinyl chloride thermoplastic elastomers, polyurethane thermoplastic elastomers, polyamide thermoplastic elastomers, polyurea thermoplastic elastomers, polyester thermoplastic elastomers, fluoride thermoplastic elastomers, and the like. These may be used alone or in combination.

The conductive agents for resistance adjustment used for the elastic belts are not limited and may be selected accordingly. Examples thereof include carbon black, graphite, metal powders such as aluminum, nickel, and the like and electric conductive metal oxides such as tin oxide, titanium oxide, antimony oxide, indium oxide, potassium titanate, antimony tin oxide (ATO), indium tin oxide (ITO), and the like. The conductive metal oxides may be coated with insulating particles such as barium sulfate, magnesium silicate, calcium carbonate, and the like. The conductive agents are not limited to those mentioned above.

Materials of the surface layer are required to prevent contamination of the photoconductor by elastic material as well as to reduce the surface friction of the transfer belt so that toner adhesion is lessened while cleaning ability and the secondary transfer property are improved. The surface layer preferably contains one type or two or more types of polyurethane resin, polyester resin, epoxy resin, and the like and materials which reduces surface energy and enhances lubrication, powders or particles such as fluorine resin, fluorine compound, carbon fluoride, titanium dioxide, silicon carbide, and the like. In addition, it is possible to use a material such as fluorine rubber that is treated with heat so that a fluorine-rich layer is formed on the surface and the surface energy is reduced.

Examples of method for producing elastic belts include, but not limited to (1) centrifugal forming in which material is poured into a rotating cylindrical mold to form a belt, (2) spray application in which a liquid paint is sprayed to form a film, (3) dipping method in which a cylindrical mold is dipped into a solution of material and then pulled out, (4) injection mold method in which material is injected into inner and outer mold, (5) a method in which a compound is applied onto a cylindrical mold and the compound is vulcanized and grounded.

Methods to prevent elongation of the elastic belt include (1) a method in which materials that prevent elongation are added to a core layer and (2) a method in which a rubber layer is formed on the core layer which is less stretchable, but the methods are not particularly limited and may be selected accordingly.

Examples of the materials constructing the core layer that prevent elongation include natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials that are in a form of a weave or thread may be used. It should be noted that the materials are not limited to those described above.

The method for forming core layer is not particularly limited and may be selected accordingly. Examples include (1) a method in which a weave that is woven in a cylindrical shape is placed on a mold or the like and a coating layer is formed on top of it, (2) a method in which a cylindrical weave is dipped in a liquid rubber or the like so that coating layer(s) is formed on one side or on both sides of the core layer and (3) a method in which a thread is twisted helically around a mold or the like in an arbitrary pitch, and then a coating layer is formed thereon.

If the coated layer is too thick, elongation and contraction of the surface becomes large and may cause cracks on the surface layer depending on the hardness of the coated layer. Moreover, as the amount of elongation and contraction increases, the size of images are also elongated and contracted significantly. Therefore, too much thickness, about 1 mm or more, is not preferable.

The transfer unit (the primary transfer unit and the secondary transfer unit) preferably contains a transfer equipment which is configured to charge so as to separate the visible image (toner image) formed on the latent electrostatic image bearing member (photoconductor) and transfer the visible image onto a recording medium. There may be only one transfer unit or may be two or more transfer units are used. Examples of the transfer equipment are a corona transfer equipment utilizing corona discharge, a transfer belt, a transfer roller, a pressure-transfer roller, an adhesion-transfer equipment, and the like.

The typical recording medium is a regular paper, and it is not particularly limited and may be selected accordingly as long as it is capable of receiving transferred, unfixed image after developing and PET bases for OHP may also be used.

The fixing is a step of fixing the visible image transferred on a recording medium using a fixing apparatus. The fixing step can be performed for toner of each color transferred to the recording medium, or in one operation when the toners of each color have been layered. The fixing apparatus is not particularly limited and may be appropriately selected in accordance with a purpose. However, conventional heating and pressurizing units are preferable. The heating and pressurizing units include a combination of a heating roller and a pressurizing roller and a combination of a heating roller, a pressurizing roller, and an endless belt, and the like. In general, the heating and pressurizing units preferably provide heating to 80° C. to 200° C.

In the present invention, for example, a conventional photo-fixing device can be used along with or in place of the fixing step and fixing unit.

Figure 9:
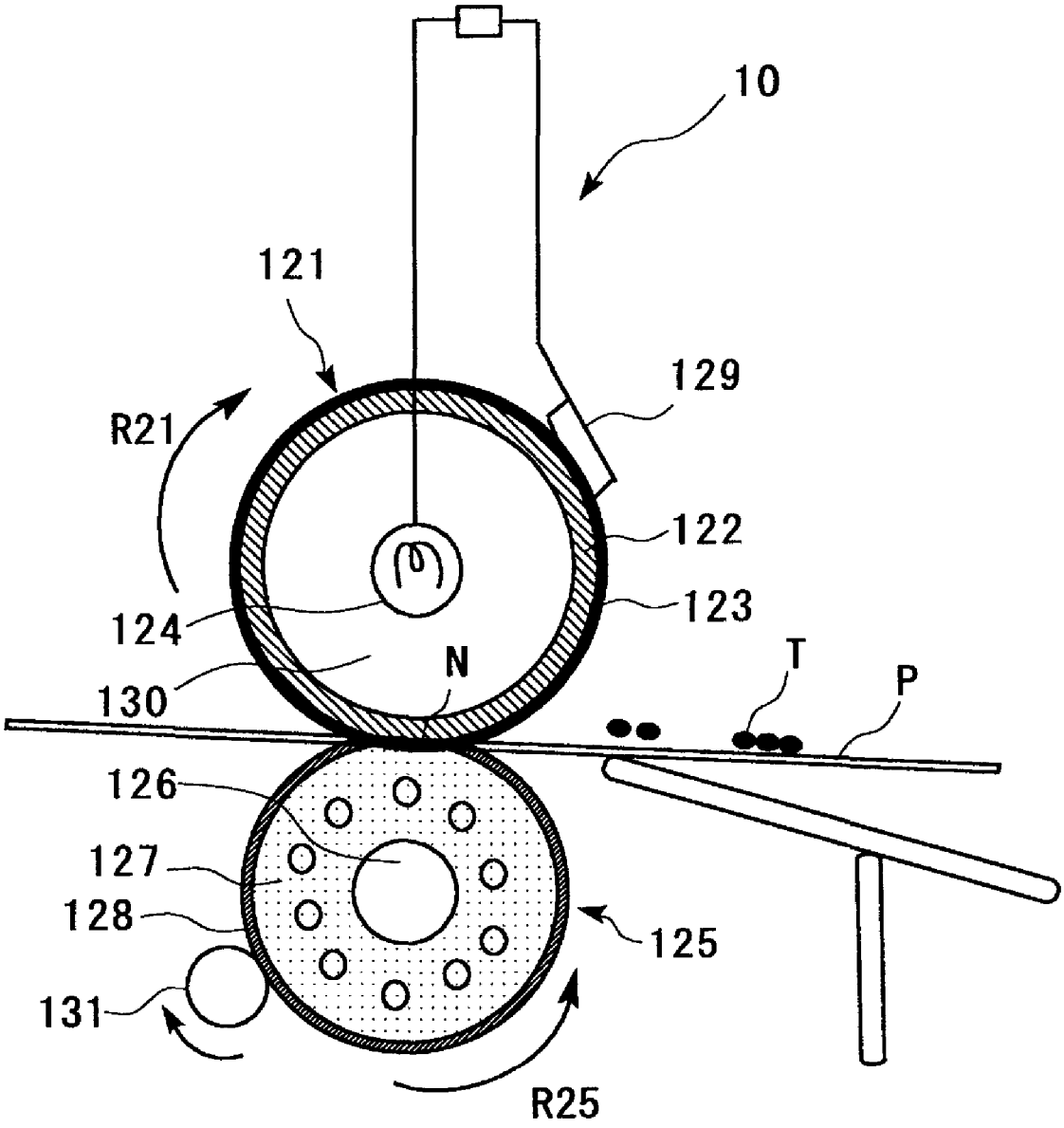
FIG. 9 is a schematic diagram showing an exemplary fixing apparatus used for the image forming apparatus of the present invention.

The fixing apparatus will be explained in detail. FIG. 9 is a schematic cross-sectional diagram showing an exemplary thermal-roller type fixing apparatus 10 which has a basic composition including a fixing roller 121 having a heating equipment 124 (hereinafter referred to as heater) such as halogen lamps, etc., an elastic layer 127 such as foamed silicone rubber, etc. on a cored bar 126 and a pressure roller 125 which is welded with pressure to a fixing roller 121. A releasing layer 128 made of PFA tubes, etc. is disposed on the elastic layer 127 of the pressure roller 125. An elastic layer 122 of silicone rubber, etc. is disposed on a cored bar 130 and further, an outer resin layer such as fluorine resin, etc. having appropriate releasing property is formed on the cored bar 130 for the purpose of preventing attachment due to viscosity of the toner. Normally, the layer thickness of the elastic layer 122 is preferably about 100 μm to 500 μm in consideration of image quality and heat transfer efficiency during fixing. The outer resin layer 123 is also composed of PFA tubes, etc. as the pressure roller 125 and the thickness of the outer resin layer 123 is preferably about 10 μm to 50 μm considering the mechanical degradation. A temperature-detecting unit 129 is disposed on the periphery side of the fixing roller 121 in order to control the heater 124 so as to maintain temperature virtually constant by detecting the surface temperature of the fixing roller 121.

The fixing roller 121 and the pressure roller 125 are welded by pressure with predefined welding force to make up a fixing nip unit N in the fixing apparatus of the above composition, and a transfer material P is carried and transported in the above fixing nip unit N by being activated by a driving unit (not shown) and rotated in arrow directions R21 and R25 respectively. The fixing roller 121 at this time is controlled by the heater 124 to maintain constant temperature and a toner image T on the transfer paper P is melted by heat while being pressurized when passing through between two rollers, cooled after coming out from the rollers and fixed on the transfer paper P as a lasing image.

The pressure roller 125 has an outer diameter of 30 mm and a wall thickness of 6 mm, and the surface is coated with conductive PFA tube and the rubber hardness on the axis is 42HS (Asca-C). The fixing roller 121 is composed of aluminum cored bar and the wall thickness is 0.4 mm. In the present composition, pressure is applied to both ends of the rollers in order to obtain nip N and the surface pressure at this time is 8.3 $N/cm^2$.

Meanwhile, in the above thermal-roller type fixing apparatus 10, the toner on the fixing roller 121 is migrated on the pressure roller 125 by the use over time and transferred, thereby causing smear on the back side of the recording paper P.

In order to remove the residual toner on the pressure roller 125, the fixing apparatus 10 of the present invention is equipped with a fixing cleaning roller 131 which is in contact with the surface of the pressure roller 125.

By having the above composition, the toner attached in minute amounts on the pressure roller 125 is removed to prevent smear on the back side of the transfer paper.

The surface temperature of the fixing roller 121 is preferably controlled in the range of 140° C. to 180° C. by means of a temperature detecting unit 129.

When the fixing apparatus 10 equipped with the fixing cleaning roller 131 is used in high temperatures, accumulated toner on the fixing cleaning roller 131 is melted by heat and reversely transferred to the pressure roller 125, in other words, reverse hot offset occurs.

It is possible to provide appropriate images stably without having fixing defects even when the fixing roller with the above range of surface temperature is used, because of the improved low-temperature fixing property of the toner of the present invention.

The charge removing is a step of applying a charge removing bias to the charged photoconductor so as to remove the charge. This is suitably performed by the charge removing unit.

The charge removing unit is not particularly limited, provided that charge removing bias is applied to the charged photoconductor to thereby remove the charge, and can be appropriately selected from the conventional charge removing units in accordance with a purpose. A suitable example thereof is a charge removing lamp.

The cleaning is a step of removing the residual electrophotographic toner on the photoconductor. This is suitably performed by means of a cleaning unit. The cleaning unit is not particularly limited, provided that the residual toner on the photoconductor is removed, and can be appropriately selected from the conventional cleaners in accordance with a purpose. Examples thereof are a magnetic blush cleaner, an electrostatic brush cleaner, a magnetic roller cleaner, a blade cleaner, a blush cleaner, a wave cleaner, and the like.

The recycling is a step of recycling the toner collected in the cleaning step to the developing unit. This is suitably performed by means of a recycling unit.

The recycling unit is not particularly limited, and may be appropriately selected from the conventional conveyance systems.

The controlling is a step of controlling each of the aforementioned steps. This is suitably performed by means of a control unit.

The control unit is not particularly limited, provided that each of the aforementioned units or members is controlled, and can be appropriately selected in accordance with a purpose. Examples thereof are devices such a sequencer, a computer, and the like.

One embodiment of the image forming method of the present invention by means of the image forming apparatus of the present invention is explained with reference to FIG. 2.

The image forming apparatus 100 shown in FIG. 2 contains the photoconductor drum 10 (referred to a photoconductor 10 hereinafter) as the latent electrostatic image bearing member, the charging roller 20 as the charging unit, the exposure device 30 as the exposure unit, the developing device 40 as the developing unit, the intermediate transfer member 50, the cleaning device 60 as the cleaning unit having a cleaning blade, and the discharging lamp 70 as the discharging unit.

The intermediate transfer member 50 is an endless belt, and looped around three rollers 51 which are disposed inside thereof. The intermediate transfer member 50 is configured to rotate in the direction shown with the arrow by means of the rollers 51. One or more of the three rollers 51 also functions as a transfer bias roller which is capable of applying a certain transfer bias (primary transfer bias) to the intermediate transfer member 50. Adjacent to the intermediate transfer member 50, there are disposed the cleaning device 90 having a cleaning blade, and the transfer roller 80 as the transfer unit which is capable of applying a transfer bias so as to transfer (secondary transfer) a developed image (toner image) to transfer sheet 95 as the final recording medium. Moreover, there is disposed the corona charger 58 for applying a charge to the toner image transferred on the intermediate transfer member 50, beside the intermediate transfer member 50, and in between the contact region of the photoconductor 10 and the intermediate transfer member 50 and the contact region of the intermediate transfer member 50 and the transfer sheet 95 in the rotational direction of the intermediate transfer member 50.

The developing device 40 contains a developing belt 41 as a developer bearing member, a black developing unit 45K, yellow developing unit 45Y, magenta developing unit 45M, and cyan developing unit 45C, in which the developing units positioned around the developing belt 41. The black developing unit 45K contains a developer container 42K, a developer supplying roller 43K, and a developing roller 44K; the yellow developing unit 45Y contains a developer container 42Y, a developer supplying roller 43Y, and a developing roller 44Y; the magenta developing unit 45M contains a developer container 42M, a developer supplying roller 43M, and a developing roller 44M; the cyan developing unit 45C contains a developer container 42C, a developer supplying roller 43C, and a developing roller 44C. In addition, the developing belt 41 is an endless belt which is looped around a plurality of belt rollers so as to rotate. Moreover, the developing belt 41 is configured to contact with the photoconductor 10 at a part thereof.

Figure 2:
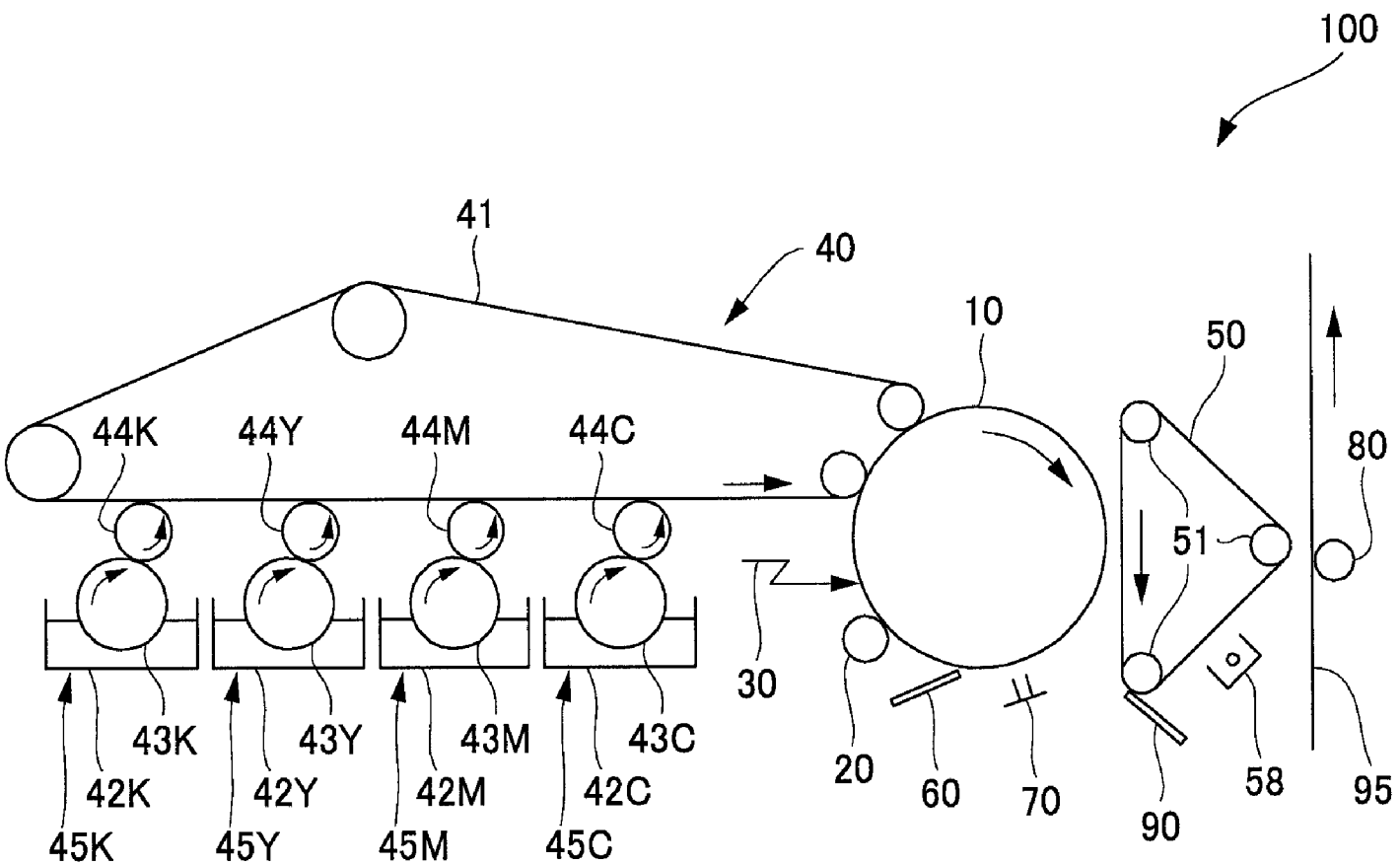
FIG. 2 is a schematic block diagram showing an exemplary image forming apparatus of the present invention.

In the image forming apparatus 100 shown in FIG. 2, the photoconductor 10 is uniformly charged by the charging roller 20. The exposure device 30 sequentially exposes the photoconductor 10 to imagewise light so as to form a latent electrostatic image. The latent electrostatic image formed on the photoconductor 10 is supplied with a toner from the developing device 40 so as to form a toner image. The roller 51 applies a bias to the toner image so as to transfer (primary transfer) the toner image onto the intermediate transfer member 50, and further applies a bias to transfer (secondary transfer) the toner image from the intermediate transfer member 50 to the transfer sheet 95. In this way, the transferred image is formed on the transfer sheet 95. Thereafter, the residual toner on the photoconductor 10 is removed by the cleaning device 60, and the charge is removed from the photoconductor 10 by the charge removing lamp 70.

Figure 3:
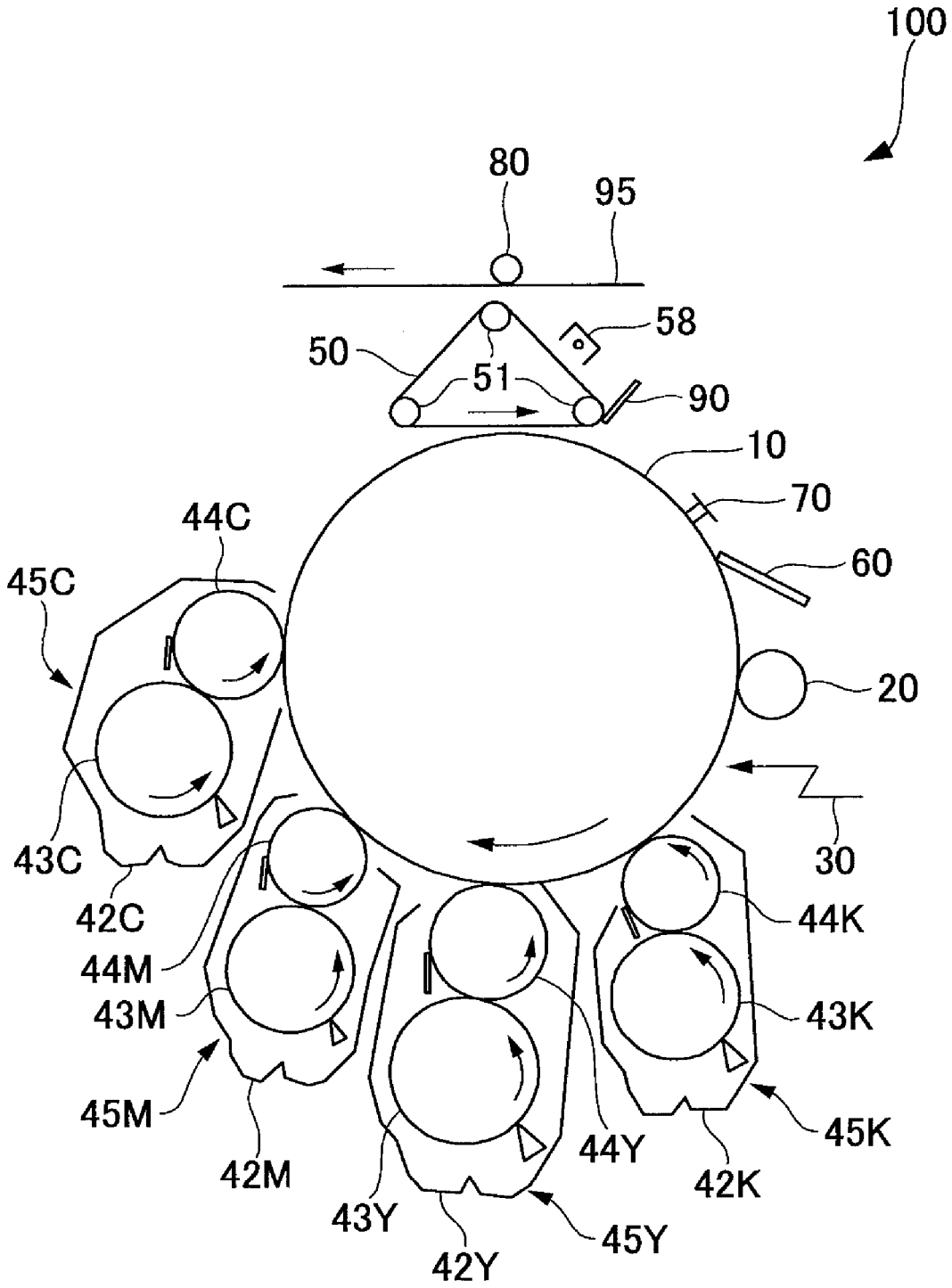
FIG. 3 is a schematic block diagram showing another exemplary image forming apparatus of the present invention.

Another embodiment of the image forming method of the present invention by means of the image forming apparatus of the present invention is explained with reference to FIG. 3. The image forming apparatus 100 shown in FIG. 3 has the identical configurations and functions to the image forming apparatus 100 shown in FIG. 2, provided that the image forming apparatus 100 is not equipped with a developing belt 41, and the black developing unit 45K, the yellow developing unit 45Y, the magenta developing unit 45M, and the cyan developing unit 45C are disposed around the photoconductor 10 so as to face each other. Note that, the reference numbers of FIG. 3 denote the same members or units to the ones in FIG. 2, if the numbers are identical.

Next, a tandem image forming apparatus which performs the information forming method of the present invention by means of the image forming apparatus of the present invention will be explained.

The tandem image forming apparatus has at least image forming elements arranged in plural numbers including latent electrostatic image bearing member, charging unit, developing unit and transfer unit. The tandem image forming apparatus can form full-color images at higher speeds because it has four image forming elements for yellow, magenta, cyan and black, forms each visible image in parallel by means of four image forming elements and superimposes one another on a recording medium or intermediate transfer member.

Figure 4:
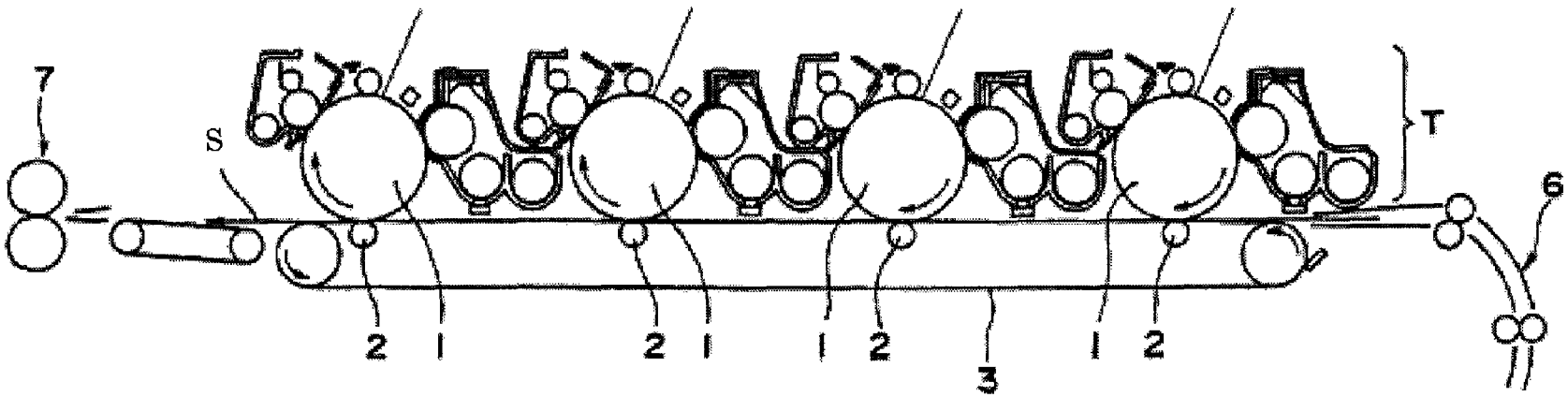
FIG. 4 is a schematic block diagram showing another exemplary image forming apparatus of the present invention.
Figure 5:
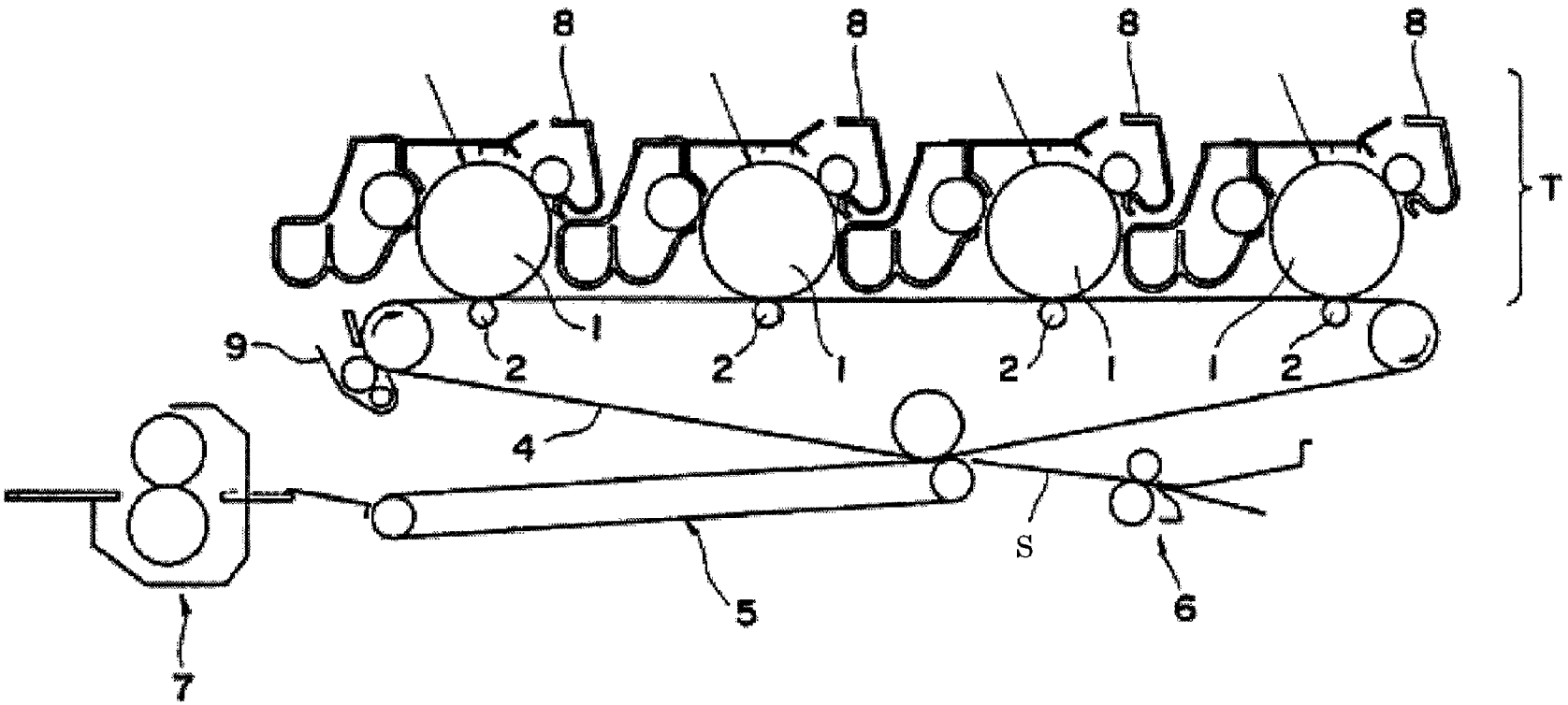
FIG. 5 is a schematic block diagram showing another exemplary image forming apparatus of the present invention.

There are two types of tandem information forming apparatus: (1) direct transfer type and (2) indirect transfer type. In direct transfer type, visible images formed on the photoconductor 1 are transferred sequentially by the transfer unit 2 to a sheet "s" of which the surface is being transported so as to pass through the transfer position, which is facing each photoconductor 1 of multiple image forming elements as shown in FIG. 4. In indirect transfer type, visible images on each photoconductor 1 of multiple image forming elements are temporarily transferred sequentially by the primary transfer unit 2 to the intermediate transfer member 4 and then all the images on the intermediate transfer member 4 are transferred together to the recording medium "s" by the secondary transfer unit 5 as shown in FIG. 5. The transfer unit 5 is generally a transfer/transport belt; however roller types may be used.

The direct transfer type (1), compared to the indirect transfer type (2), has a drawback of glowing in size in a direction of sheet transportation because the paper feeding unit 6 must be placed on the upper side of the tandem image forming part T where the photoconductor 1 is aligned, whereas the fixing unit 7 must be placed on the lower side of the apparatus. On the other hand, in the indirect transfer type (2), the secondary transfer site may be installed relatively freely, and the paper feeding unit 6 and the fixing unit 7 may be placed together with the tandem image forming part T making it possible to be downsized.

To avoid size-glowing in the direction of sheet transportation, the fixing unit 7 must be placed close to the tandem image forming part T. However, it is impossible to place the fixing unit 7 in a way that gives enough space for sheet "s" to bend, and the fixing unit 7 may affect the image forming on the upper side by the impact generated from the leading end of the sheet "s" as it approaches the fixing unit 7 (this becomes distinguishable with a thick sheet), or by the difference between the transport speed of the sheet when it passes through the fixing unit 7 and when it is transported by the transfer/transport belt. The indirect transfer type, on the other hand, allows the fixing unit 7 to be placed in a way that gives sheet "s" an enough space to bend and the fixing unit 7 has almost no effect on the image forming.

For above reasons, the indirect transfer type of the tandem image forming apparatus is particularly being emphasized recently. And this type of color image forming apparatus as shown in FIG. 5, prepares for the next image forming by removing the residual toner on the photoconductor 1 by the photoconductor cleaning unit 8 to clean the surface of the photoconductor 1 after the primary transfer. It also prepares for the next image forming by removing the residual toner on the intermediate transfer member 4 by the intermediate transfer member cleaning unit 9 to clean the surface of the intermediate transfer member 4 after the secondary transfer.

Figure 6:
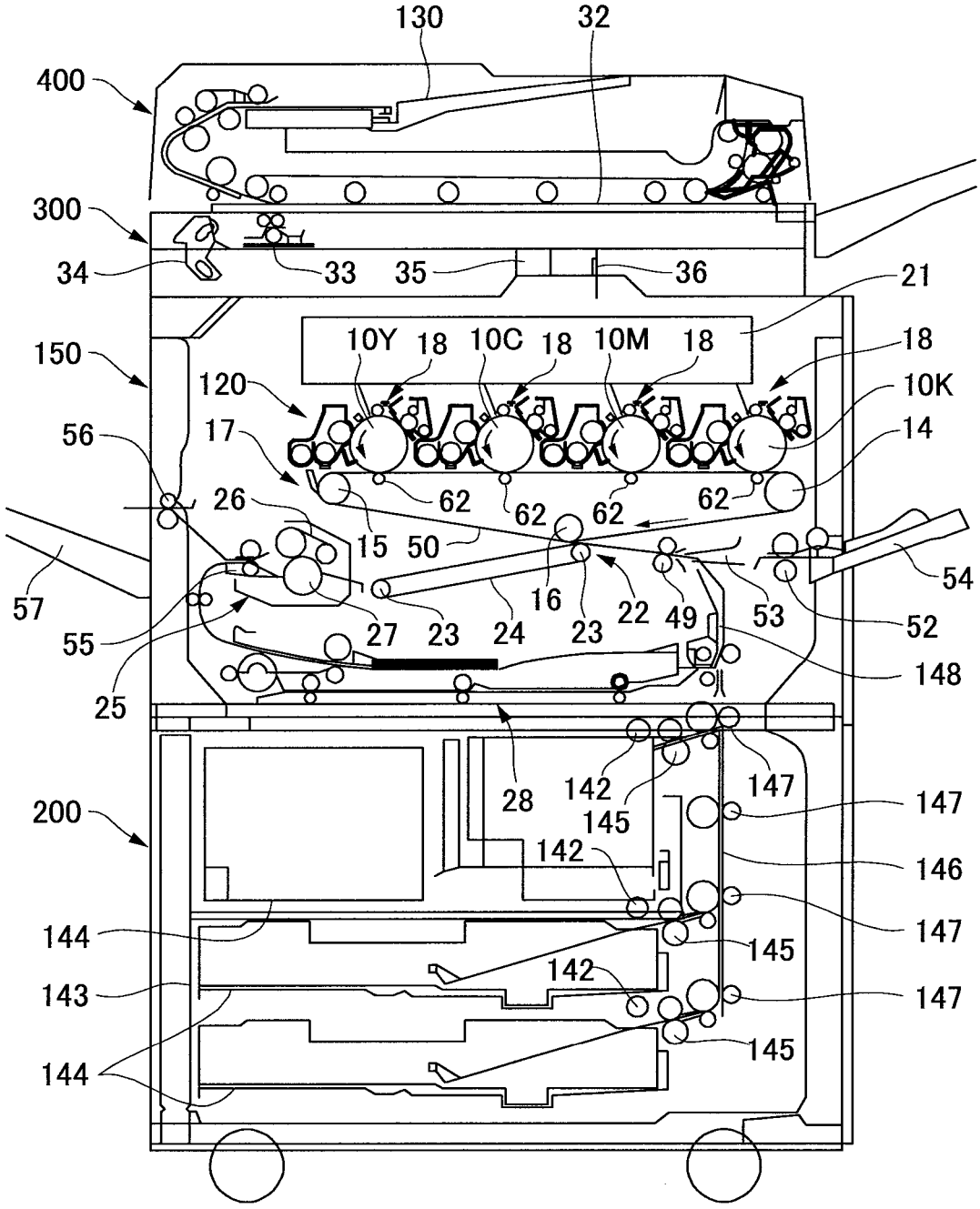
FIG. 6 is a schematic block diagram showing another exemplary image forming apparatus of the present invention.

The tandem image forming apparatus 100 as shown in FIG. 6 is a tandem color-image forming apparatus. The tandem image forming apparatus 100 contains a copying machine main body 150, the feeder table 200, the scanner 300, and an automatic document feeder (ADF) 400.

The copying machine main body 150 contains the endless-belt intermediate transfer member 50 in the middle part. The intermediate transfer member 50 shown in FIG. 6 is looped around support rollers 14, 15 and 16 and is configured to rotate in a clockwise direction in FIG. 6. There is disposed the cleaning device 17 for the intermediate transfer member adjacent to the support roller 15. The cleaning device 17 for the intermediate transfer member is capable of removing a residual toner on the intermediate transfer member 50 after transferring a toner image.

Above the intermediate transfer member 50 looped around the support rollers 14 and 15, four image-forming units 18 of yellow, cyan, magenta, and black are arrayed in parallel in a conveyance direction of the intermediate transfer member 50 to thereby constitute the tandem developing device 120. There is also disposed the exposure unit 21 adjacent to the tandem developing device 120. The secondary transfer unit 22 is disposed on the opposite side of the intermediate transfer member 50 to where the tandem developing device 120 is disposed. The secondary transfer device 22 contains the secondary transfer belt 24 of an endless belt, which is looped around a pair of rollers 23. The secondary transfer device 22 is configured so that the transfer sheet conveyed on the secondary transfer belt 24 comes in contact with the intermediate transfer member 50. Adjacent to the secondary transfer device 22, there is disposed the image-fixing device 25.

In the tandem image-forming apparatus 100, the sheet reverser 28 is disposed adjacent to the secondary transfer device 22 and the image-fixing device 25. The sheet reverser 28 is configured to reverse a transfer sheet in order to form images on the both sides of the transfer sheet.

Next, full-color image formation (color copy) is formed by means of the tandem developing device 120 in the following manner. Initially, a document is placed on the document platen 130 of the automatic document feeder (ADF) 400. Alternatively, the automatic document feeder 400 is opened, the document is placed on the contact glass 32 of the scanner 300, and the automatic document feeder 400 is closed to press the document.

At the time of pushing a start switch (not shown), the document placed on the automatic document feeder 400 is transported onto the contact glass 32. In the case that the document is initially placed on the contact glass 32, the scanner 300 is immediately driven to operate the first carriage 33 and the second carriage 34. Light is applied from a light source to the document, and reflected light from the document is further reflected toward the second carriage 34 at the first carriage 33. The reflected light is further reflected by a mirror of the second carriage 34 and passes through the image-forming lens 35 into the read sensor 36 to thereby read the color document (color image). The read color image is interpreted as image information of black, yellow, magenta and cyan.

Figure 7:
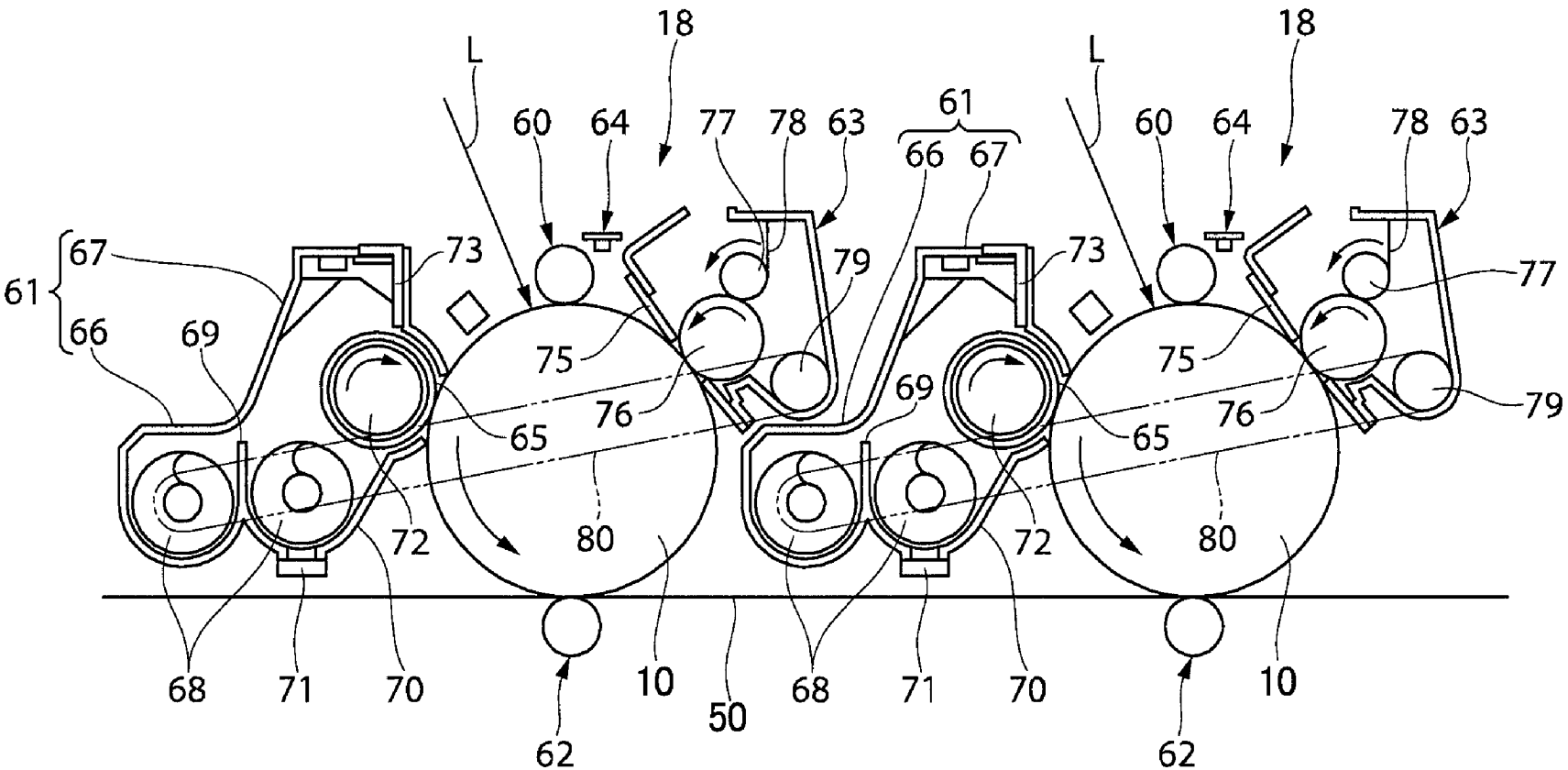
FIG. 7 is an enlarged diagram of the image forming element portion of FIG. 6.

Each of black, yellow, magenta, and cyan image information is transmitted to respective image-forming units 18 (black image-forming unit, yellow image-forming unit, magenta image-forming unit, and cyan image-forming unit) of the tandem developing device 120, and then toner images of black, yellow, magenta, and cyan are separately formed in each image-forming unit 18. With respect to each of the image-forming units 18 (black image-forming unit, yellow image-forming unit, magenta image-forming unit, and cyan image-forming unit) of the tandem developing device 120, as shown in FIG. 7, there are disposed a photoconductor 10 (a photoconductor for black 10K, a photoconductor for yellow 10Y, a photoconductor for magenta 10M, or a photoconductor for cyan 10C), a charger 60 which uniformly charges the photoconductor, an exposure unit (L) which forms a latent electrostatic image corresponding to each color image on the photoconductor based on each color image information, an developing device 61 which develops the latent electrostatic image with the corresponding color toner (a black toner, a yellow toner, a magenta toner, or a cyan toner) to form a toner image of each color, the transfer charger 62 for transferring the toner image to the intermediate transfer member 50, the photoconductor cleaning device 63, and the charge removing unit 64. Accordingly, each mono-color image (a black image, a yellow image, a magenta image, and a cyan image) is formed based on the corresponding color-image information. The thus obtained black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred (primary transfer) onto the intermediate transfer member 50 which rotate by means of support rollers 14, 15 and 16. These toner images are superimposed on the intermediate transfer member 50 to form a composite color image (color transferred image).

One of feeder rollers 142 of the feeder table 200 is selectively rotated, sheets are ejected from one of multiple feeder cassettes 144 in the paper bank 143 and are separated in the separation roller 145 one by one into the feeder path 146, are transported by the transport roller 47 into the feeder path 148 in the copying machine main body 150 and are bumped against the resist roller 49. Note that, the resist roller 49 is generally earthed, but it may be biased for removing paper dust of the sheets.

The resist roller 49 is rotated synchronously with the movement of the composite color image (transferred image) on the intermediate transfer member 50 to transport the sheet (recording medium) into between the intermediate transfer member 50 and the secondary transfer device 22, and the composite color image (transferred image) is transferred onto the sheet (recording medium) by action of the secondary transfer device 22. After transferring the toner image, the residual toner on the intermediate transfer member 50 is cleaned by means of the intermediate cleaning device 17.

The sheet to which the color image is transferred and formed is transported by the secondary transfer device 22 into the image-fixing device 25, is applied with heat and pressure in the image-fixing device 25 to fix the composite color image (transferred image) to the sheet (recording medium). Thereafter, the sheet changes its direction by action of the switch blade 55, is ejected by the ejecting roller 56 and is stacked on the output tray 57. Alternatively, the sheet changes its direction by action of the switch blade 55 into the sheet reverser 28, turns the direction, is transported again to the transfer section, subjected to an image formation on the back surface thereof. The sheet bearing images on both sides thereof is then ejected with assistance of the ejecting roller 56, and is stacked on the output tray 57.

Figure 8:
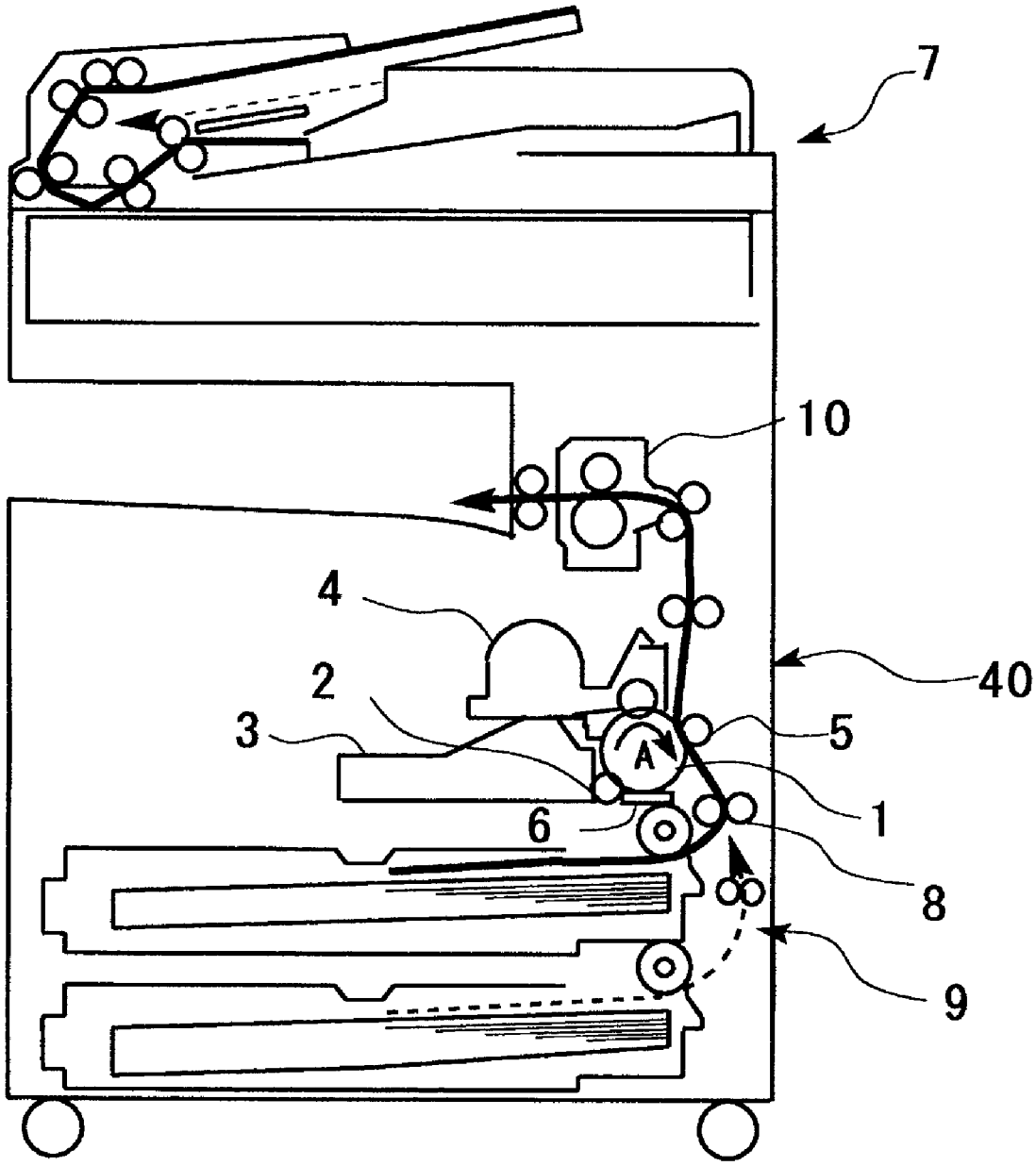
FIG. 8 is a schematic block diagram further showing another exemplary image forming apparatus of the present invention.

FIG. 8 is a schematic block diagram showing an exemplary image forming apparatus using the image forming method of the present invention. The digital copier of FIG. 8 employs known electrophotographic system and is internally equipped with a drum-shaped photoconductor 1. In the surrounding area of the photoconductor 1, a charging device 2, exposure device 3, developing device 4, transfer device 5, cleaning device 6 and fixing device 10, which are configured to operate electrophotographic copying processes, are arranged along the rotating direction as shown by an arrow A. The exposure device 3 forms a latent electrostatic image on the photoconductor 1 based on the image signals read by a reading device (not shown) from the documents placed on a document placing table 7 on upper surface of the copier. The latent electrostatic image formed on the photoconductor 1 is developed by the developing device 4 to form a toner image and the toner image is transferred electrostatically to a transfer sheet transported from a sheet feeder 9 by means of the transfer device 5. The transfer sheet on which the toner image is formed is transported to the fixing device 10 and ejected from the apparatus after fixing. At the same time, the photoconductor 1 containing untransferred part or smear is cleaned by means of the cleaning device 6 to prepare for the next image forming step.

The image forming method and image forming apparatus of the present invention uses the toner of the present invention which is capable of exhibiting excellent low-temperature fixing properties and offset resistance performance, thereby efficiently forming high quality images.

EXAMPLE

Herein below, with referring to Examples, the invention is explained in detail and the following Examples should not be construed as limiting the scope of this invention. In the following Examples, "parts" represents "parts by mass", "%" represents "% by mass", "AV" indicates acid value and "OHV" indicates hydroxyl value unless indicated otherwise.

Example A-1

[Synthesis of Polyester (A1)]

In a reaction vessel equipped with cooling tube, stirrer and nitrogen introducing tube, 809 parts of bisphenol A propylene oxide 3-mol adduct, 196 parts of terephthalic acid, 44 parts of adipic acid, 5.8 parts of trimellitic anhydride and 2 parts of dibutyltin oxide were put and reacted at 230° C. and normal pressures for 8 hours and then further reacted for 5 hours while dehydrating at a reduced pressure of 10 mmHg to 15 mmHg to obtain a polyester (A1) of OHV52 and AV0.8.

The mass average molecular weight Mw of the polyester (A1) was 10,200, and the glass transition temperature Tg was 30.2° C.

[Synthesis of Polyester Prepolymer (B1)]

After 409 parts of polyester (A1) described in Example A-1 and 495 parts of ethyl acetate were put in a reaction vessel equipped with cooling tube, stirrer and nitrogen introducing tube and dissolved while being stirred at room temperature, 95.5 parts of isophorone diisocyanate was added and reacted at 80° C. for 18 hours to obtain an ethyl acetate solution (solid content of 50.5%) of polyester prepolymer (B1).

The viscosity of the obtained polyester prepolymer solution was 920 mPa·s/25° C. and the content of isocyanate was 1.59%.

Production Example of Toner

In a beaker, 14.3 parts of prepolymer (B1), 55 parts of polyester resin (PE4) and 78.6 parts of ethyl acetate were put and stir dissolved. And then separately, 10 parts of rice wax as a releasing agent, 4 parts of copper phthalocyanine blue pigment and 100 parts of ethyl acetate were put in a bead mill and dispersed for 30 minutes. Two liquids were mixed, stirred at 12,000 rpm frequency for 5 minutes using a TK Homomixer, and dispersed for 10 minutes by means of a bead mill. The obtained product was referred to as toner-material oily dispersion liquid (1).

In a beaker, 306 parts of deionized water, 265 parts of 10% suspension liquid of tricalcium phosphate and 0.2 parts of dodecylbenzene sodium sulfonate were put and while being mixed at 12,000 rpm with the TK Homomixer, the above toner-material oily dispersion liquid (1) and 2.7 parts of ketimine compound (b1) were added and reacted while still being stirred for 30 minutes. The organic solvent was removed from the dispersion liquid (viscosity: 5,500 mPa·s) after reaction at a temperature of 50° C. or less within 1.0 hour after pressure was reduced, the dispersion liquid was filtered, washed, dried and then classified by force to obtain a spherical toner base.

100 parts of the obtained base particles and 0.25 parts of charge controlling agent (Bontron E-84 manufactured by Orient Chemical Industries, Ltd.) were put in a Q-type mixer (manufactured by Mitsui Mining Co., Ltd.) and mixed while setting the rim speed of turbine blade at 50 m/sec. In this case, 5 cycles of the mixing operation was performed with one cycle consisting of 2 minutes of driving and 1 minute of pausing and the total treating time was for 10 minutes. Moreover, 0.5 parts of hydrophobic silica (H2000 manufactured by Clariant (Japan) K.K.) was added and mixed. In this case, 5 cycles of the mixing operation were performed at a rim speed of 15 m/sec with 1 cycle consisting of 30 seconds of mixing and 1 minute of pausing to obtain the final toner (I).

Example A-2

[Synthesis of Polyester (A2)]

The polyester (A2) of OHV43 and AV0.7 was obtained similarly to Example A-1, except for using 730 parts of bisphenol A propylene oxide 3-mol adduct, 65 parts of bisphenol A ethylene oxide 2-mol adduct, 234 parts of terephthalic acid, 23 parts of adipic acid, 6.1 parts of trimellitic anhydride and 2 parts of dibutyltin oxide.

The mass average molecular weight Mw of the polyester (A2) was 13,300, and the glass transition temperature Tg was 35.0° C.

[Synthesis of Polyester Prepolymer (B2)]

The ethyl acetate solution (solid content of 50.5%) of polyester prepolymer (B2) was obtained similarly to the [Synthesis of Polyester Prepolymer (B1)] of Example A-1, except for using 422 parts of polyester (A2) described in Example A-2, 495 parts of ethyl acetate and 83.4 parts of isophorone diisocyanate.

The viscosity of the polyester prepolymer solution was 1,380 mPa·s/25° C. and the content of isocyanate was 1.36%.

And afterward, the final toner (II) was obtained with the similar operation as described in (Production Example of Toner) of Example A-1.

Example A-3

[Synthesis of Polyester (A3)]

The polyester (A3) of OHV32 and AV1.4 was obtained similarly to Example A-1, except for using 649 parts of bisphenol A propylene oxide 3-mol adduct, 70 parts of bisphenol A propylene oxide 2-mol adduct, 65 parts of bisphenol A ethylene oxide 2-mol adduct, 234 parts of terephthalic acid, 37 parts of adipic acid, 6.5 parts of trimellitic anhydride and 2 parts of dibutyltin oxide.

The mass average molecular weight Mw of the polyester (A3) was 19,200, and the glass transition temperature Tg was 40.0° C.

[Synthesis of Polyester Prepolymer (B3)]

The ethyl acetate solution (solid content of 50.5%) of polyester prepolymer (B3) was obtained similarly to the [Synthesis of Polyester Prepolymer (B1)] of Example A-1, except for using 438 parts of polyester (A3) described in Example A-3, 495 parts of ethyl acetate and 67.3 parts of isophorone diisocyanate.

The viscosity of the obtained polyester prepolymer solution was 2,460 mPa·s/25° C. and the content of isocyanate was 1.05%.

And afterward, the final toner (III) was obtained with the similar operation as described in (Production Example of Toner) of Example A-1.

Example A-4

[Synthesis of Polyester (A4)]

The polyester (A4) of OHV28 and AV1.5 was obtained similarly to Example A-1, except for using 572 parts of bisphenol A propylene oxide 3-mol adduct, 140 parts of bisphenol A propylene oxide 2-mol adduct, 66 parts of bisphenol A ethylene oxide 2-mol adduct, 244 parts of terephthalic acid, 38 parts of adipic acid, 3.4 parts of trimellitic anhydride and 2 parts of dibutyltin oxide.

The mass average molecular weight Mw of the polyester (A4) was 31,200, and the glass transition temperature Tg was 44.5° C.

[Synthesis of Polyester Prepolymer (B4)]

The ethyl acetate solution (solid content of 50.5%) of polyester prepolymer (B4) was obtained similarly to Example A-1, except for using 443 parts of polyester (A4) described in Example A-4, 495 parts of ethyl acetate and 62 parts of isophorone diisocyanate.

The viscosity of the obtained polyester prepolymer solution was 3,830 mPa·s/25° C. and the content of isocyanate was 0.95%.

Afterward, the final toner (IV) was obtained with the similar operation as described in (Production Example of Toner) of Example A-1.

Comparative Example A-1

[Synthesis of Polyester (A5)]

The polyester (A5) of OHV54 and AV0.9 was obtained similarly to Example A-1, except for using 81 parts of bisphenol A propylene oxide 2-mol adduct, 681 parts of bisphenol A ethylene oxide 2-mol adduct, 275 parts of terephthalic acid, 7 parts of adipic acid, 22 parts of trimellitic anhydride and 2 parts of dibutyltin oxide.

The mass average molecular weight Mw of the polyester (A5) was 9,200, and the glass transition temperature Tg was 54.3° C.

[Synthesis of Polyester Prepolymer (B5)]

The ethyl acetate solution (solid content of 50.5%) of polyester prepolymer (B5) was obtained similarly to Example A-1, except for using 404 parts of polyester (A5) described in Comparative Example A-1, 495 parts of ethyl acetate and 101 parts of isophorone diisocyanate.

The viscosity of the obtained polyester prepolymer solution was 960 mPa·s/25° C. and the content of isocyanate was 1.70%.

Afterward, the final toner (V) was obtained with the similar operation as described in (Production Example of Toner) of Example A-1.

Comparative Example A-2

[Synthesis of Polyester (A6)]

The polyester (A6) of OHV20 and AV1.8 was obtained similarly to Example A-1, except for using 415 parts of bisphenol A propylene oxide 3-mol adduct, 214 parts of bisphenol A propylene oxide 2-mol adduct, 134 parts of bisphenol A ethylene oxide 2-mol adduct, 260 parts of terephthalic acid, 20 parts of adipic acid, 3.6 parts of trimellitic anhydride and 2 parts of dibutyltin oxide.

The mass average molecular weight Mw of the polyester (A6) was 96,000, and the glass transition temperature Tg was 59.6° C.

[Synthesis of Polyester Prepolymer (B6)]

The ethyl acetate solution (solid content of 50.5%) of polyester prepolymer (B6) was obtained similarly to Example A-2, except for using 457 parts of polyester (A6) described in Comparative Example A-2, 495 parts of ethyl acetate and 48 parts of isophorone diisocyanate.

The viscosity of the obtained polyester prepolymer solution was 6,300 mPa·s/25° C. and the content of isocyanate was 0.68%.

Afterward, the final toner (VI) was obtained with the similar operation as described in (Production Example of Toner) of Example A-1.

The properties of polyester resins (A1) to (A4) used for the toners (I) to (VI) of the present invention and polyester resins (A5) to (A6) used for the toners (V) to (VI) produced for comparison are shown in Table 1.

TABLE 1

| | Polyester Resin | Mass Average Molecular Weight (Mw) | Content of Bisphenol A Propyleneoxide 3-mol Adduct (parts) | Content of Bisphenol A Alkyleneoxide 2-mol Adduct* (parts) | Glass Transition Temperature (Tg) [° C.] | Acid Value [KOHmg/g] | Hydroxyl Value [KOHmg/g] |
|---|---|---|---|---|---|---|---|
| Example A-1 | A1 | 10,200 | 809 | none | 30.2 | 0.8 | 52 |
| Example A-2 | A2 | 13,300 | 730 | 65 | 35.0 | 0.7 | 43 |
| Example A-3 | A3 | 19,200 | 649 | 135 | 40 | 1.4 | 32 |
| Example A-4 | A4 | 31,200 | 572 | 206 | 44.5 | 1.5 | 28 |
| Comp. Ex. A-1 | A5 | 9,200 | none | 762 | 54.3 | 0.9 | 54 |
| Comp. Ex. A-2 | A6 | 96,000 | 415 | 348 | 59.6 | 1.8 | 20 |

*Total content of bisphenol A propylene oxide 2-mol adduct and bisphenol A ethylene oxide 2-mol adduct The low-temperature fixing properties and high-temperature offset resistance of the above toners (I) to (IV) were evaluated. Moreover, the above toners (V) to (VI) were evaluated similarly for comparison. The evaluation items and evaluation methods of toners are as follows.

<Evaluation Method of Fixing Property>

The fixing device (surface pressure: 8.3N/cm$^2$) of the composition as shown in FIG. 9 was mounted in imagio Neo 452 (manufactured by Ricoh Company, Ltd.) and copying was performed at various heater temperatures to obtain fixed images. A piece of mending tape (manufactured by Sumitomo 3M Ltd.) was attached to the image after fixing and peeled off slowly after being applied with a constant pressure. The image densities before and after attaching the tape were measured by means of Macbeth densitometer and fixing ratio was calculated by the following equation. The temperature of the fixing roller was lowered by stages and the temperature at which the fixing ratio expressed by the following equation becomes 80% or less was defined as a fixing temperature.

Fixing ratio (%)=image density with tape/image density×100

<Evaluation Method of Hot Offset Generation Temperature>

The 2 cm×2 cm black solid images were obtained by using the fixing device and evaluation method similar to the ones used for the above fixing property evaluation and the temperature, at which hot offset occurs when fixed images are obtained by copying at various heater temperatures, was defined as hot offset generation temperature.

The evaluation results of the toners are shown in Table 2.

TABLE 2

| | Toner | Fixing Temperature (° C.) | Hot Offset Temperature (° C.) |
|---|---|---|---|
| Example A-1 | I | 150 | 230 |
| Example A-2 | II | 150 | 240 or more |
| Example A-3 | III | 155 | 240 or more |
| Example A-4 | IV | 160 | 240 or more |
| Comp. Ex. A-1 | V | 165 | 240 or more |
| Comp. Ex. A-2 | VI | 175 | 240 or more |

As shown in Table 2, the low-temperature fixing properties of Examples A-1 to A-4 using the toners (I) to (IV) of the present invention were excellent while maintaining the hot offset resistance and appropriate results were obtained.

On the other hand, the low-temperature fixing properties of Comparative Examples A-1 to A-2 were inferior because molecular weight of the polyesters contained in the toners (V) to (VI) as precursor materials were outside the stipulated range of the present invention.

The measurements of volume average particle diameter (Dv), particle size distribution (Dv/Dn), rate of content (NCO %) of isocyanate group, acid value, hydroxyl value and glass transition temperature (Tg) of toners of Examples B-1 to B-6 and Comparative Examples B-1 to B-2 were operated as follows.

<Volume Average Particle Diameter (Dv) and Particle Size Distribution (Dv/Dn)>

The volume average particle diameter and particle size distribution of the toner were measured by means of a particle size measuring instrument (Coulter Counter TAII manufactured by Beckmann Coulter Inc.) with aperture of 100 μm. The values of (volume average particle diameter/number average particle diameter) were calculated from these results.

<Measurement of Rate of Content of Isolated Isocyanate Group>

The rate of content of isolated isocyanate group (NCO %) was measured by the method based on JIS K1603.

<Measurement Method of Acid Value>

The acid value was measured by the method specified in JIS K0070. Although solvents such as dioxane or THF, etc. were used in case samples were infusible.

<Measurement Method of Hydroxyl Value>

The hydroxyl value was measured by the method specified in JIS K0070. Although solvents such as dioxane or THF, etc. were used in case samples were infusible.

<Glass Transition Temperature (Tg)>

The TG-DSC system, TAS-100 manufactured by Rigaku Industrial Corp. was used as a measuring device of the glass transition temperature (Tg).

First, 10 mg of sample was put in an aluminum sample container; the container was put on a holder unit and was set in an electric furnace. After it was heated to 150° C. from room temperature with a rate of temperature rise of 10° C./min, the sample was left unattended at 150° C. for 10 minutes, cooled to room temperature and left unattended for 10 minutes and then again heated to 150° C. with a rate of temperature rise of 10° C./min under nitrogen atmosphere to perform DSC measurement. The glass transition temperature Tg was calculated from tangential line of endothermic curve, which is in neighborhood of Tg, and contact point of base line using an analysis system in the TAS-100 system.

Example B-1

—Synthesis of Organic Fine Particle Emulsion—

First, 683 parts of water, 11 parts of sodium salt of sulfuric acid ester of ethylene oxide adduct of methacrylic acid (Eleminol RS-30 manufactured by Sanyo Chemical Industries, Ltd.), 83 parts of styrene, 83 parts of methacrylic acid, 110 parts of butyl acrylate and 1 part of ammonium persulfate were put in a reaction vessel equipped with stirrer and thermometer and stirred at 400 rotation/min. for 15 minutes to obtain a white emulsion. The emulsion was heated to a temperature within the system of 75° C. and reacted for 5 hours. Next, 30 parts of 1% water solution of ammonium persulfate was added and matured at 75° C. for 5 hours to obtain an aqueous dispersion liquid of vinyl resin (copolymer of styrene-methacrylic acid-butyl acrylate-sodium salt of sulfuric acid ester of ethylene oxide adduct of methacrylic acid). This was referred to as [fine particle dispersion liquid 1].

The volume average particle diameter of the fine particles contained in the obtained [fine particle dispersion liquid 1] was measured by means of a particle size distribution measuring instrument (LA-920 manufactured by Horiba Ltd.) which uses laser beam scattering method and the result was 105 nm. Furthermore, a part of [fine particle dispersion liquid 1] was dried to isolate resin portion. The glass transition temperature (Tg) of the resin portion was 59° C. and the mass average molecular weight (Mw) was 150,000.

—Preparation of Aqueous Phase—

990 parts of water, 83 parts of [fine particle dispersion liquid 1], 37 parts of 48.5% water solution of sodium dodecyl diphenyl ether disulfonate (Eleminol MON-7 manufactured by Sanyo Chemical Industries, Ltd.) and 90 parts of ethyl acetate were stir mixed to obtain a milky white liquid. This was referred to as [water phase 1].

—Synthesis of Low-Molecular-Weight Polyester—

In a reaction vessel equipped with cooling tube, stirrer and nitrogen introducing tube, 229 parts of bisphenol A ethylene oxide 2-mol adduct, 529 parts of bisphenol A propylene oxide 3-mol adduct, 208 parts of terephthalic acid, 46 parts of adipic acid and 2 parts of dibutyltin oxide were put and reacted at 230° C. under normal pressures for 8 hours. And after being reacted under reduced pressure of 10 mmHg to 15 mmHg for 5 hours, 44 parts of trimellitic anhydride was put in the reaction vessel and reacted at 180° C. under normal pressures for 2 hours to obtain [low-molecular-weight polyester 1].

The glass transition temperature (Tg) of the obtained [low-molecular-weight polyester 1] was 43° C., the mass average molecular weight (Mw) was 6,700, number average molecular weight was 2,500 and acid value was 25.

—Preparation of Masterbatch (MB)—

1,200 parts of water, 540 parts [DBP oil absorption=42 ml/100 mg, pH=9.5] of carbon black (Printex 35 manufactured by Degussa Japan Co., Ltd.) and 1,200 parts of polyester resin (RS801 manufactured by Sanyo Chemical Industries, Ltd.) were added and mixed by means of Henschel mixer (manufactured by Mitsui Mining Co., Ltd.). The obtained mixed product was cooled by rolling and pulverized by means of a pulverizer after kneading at 150° C. for 30 minutes using a double roll to obtain a carbon black masterbatch. This was referred to as [masterbatch 1].

—Synthesis of Prepolymer 1—

In a reaction vessel equipped with cooling tube, stirrer and nitrogen introducing tube, 463 parts of propylene glycol, 657 parts of terephthalic acid, 96 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 1].

The mass average molecular weight of the obtained [intermediate member polyester 1] was 28,000, glass transition temperature (Tg) was 36° C., acid value was 0.5 and hydroxyl value was 16.5.

Next, in a reaction vessel equipped with cooling tube, stirrer and nitrogen introducing tube, 250 parts of [intermediate member polyester 1], 18 parts of isophorone diisocyanate and 250 parts of ethyl acetate were put and reacted at 100° C. for 5 hours to obtain [prepolymer 1].

The rate of content of isocyanate in the obtained [prepolymer 1] was 0.61%.

—Prepartion of Oil Phase—

In a reaction vessel equipped with stirrer and thermometer, 378 parts of [low-molecular-weight polyester 1], 110 parts of carnauba wax, 22 parts of CCA (salicylic acid metallic complex E-84 manufactured by Orient Chemical Industries, Ltd.) and 947 parts of ethyl acetate were put and heated to 80° C. while stirring, and then cooled to 30° C. for 1 hour after retaining it at 80° C. for 5 hours. Next, 500 parts of [masterbatch 1] and 500 parts of ethyl acetate were put in the reaction vessel and mixed for 1 hour to obtain a dissolved product. This was referred to as [raw material liquid solution 1].

Next, 1,324 parts of [raw material liquid solution 1] was transferred to the reaction vessel and dispersal of carbon black and wax was performed by means of a bead mill (Ultra Visco Mill manufactured by Aimex Co., Ltd.) under a condition of solution-sending speed of 1 kg/hr, disc rim speed of 6 m/sec., 0.5 mm zirconia bead fill of 80% by volume and 3-pass operation.

Next, 1,324 parts of 65% ethyl acetate solution of [low-molecular-weight polyester 1] was added to obtain a dispersion liquid with one pass operation using a bead mill of the same condition as above. This was referred to as [pigment and wax dispersion liquid 1].

The solid content (130° C., 30 minutes) of the obtained [pigment and wax dispersion liquid 1] was 50%.

—Emulsification—

749 parts of [pigment and wax dispersion liquid 1], 115 parts of [prepolymer 1] and 1.3 parts of isophorone diamine were put in a container and mixed at 5,000 rpm for 1 minute using TK Homomixer (manufactured by Tokushu Kika Kogyo Co., Ltd.). And then 1,200 parts of [water phase 1] was added in the reaction vessel and mixed at 13,000 rpm frequency for 20 minutes using TK Homomixer to obtain an aqueous medium dispersion liquid. This was referred to as [emulsified slurry 1].

—Removal of Organic Solvent—

The [emulsified slurry 1] was put in a reaction vessel equipped with stirrer and thermometer and matured at 45° C. for 4 hours after solvents were removed at 30° C. for 8 hours to obtain a dispersion liquid with organic solvents distilled away. This was referred to as [dispersed slurry 1].

The obtained [dispersed slurry 1] had a volume average particle diameter of 5.13 μm and a number average particle diameter of 4.51 μm (measured by means of Multisizer II).

—Washing and Drying—

After 100 parts of [dispersed slurry 1] was filtered under reduced pressure, washing and drying were performed as follows.

(1) 100 parts of deionized water was added to a filter cake and filtered after mixing by means of TK Homomixer at 12,000 rpm for 10 minutes.

(2) 100 parts of distillated water was added to the filter cake of (1) and filtered under reduced pressure after mixing by means of TK Homomixer at 12,000 rpm for 30 minutes.

(3) 100 parts of 10% hydrochloric acid was added to the filter cake of (2) and filtered after mixing by means of TK Homomixer at 12,000 rpm for 10 minutes.

(4) 300 parts of deionized water was added to the filter cake of (3) and filtered for twice after mixing by means of TK Homomixer at 12,000 rpm for 10 minutes to obtain a filter cake.

The filter cake was dried at 45° C. for 48 hours using an air circulating dryer and screened with a 75 μm-mesh sieve to obtain a toner. This was referred to as [toner 1].

Example B-2

The [toner 2] was prepared similarly to Example B-1, except for using [prepolymer 2] synthesized as follows instead of [prepolymer 1] and changing the amount of isophorone diamine from 1.3 parts to 1.2 parts.

—Synthesis of Prepolymer 2—

In a reaction vessel equipped with cooling tube, stirrer and nitrogen introducing tube, 428 parts of ethylene glycol, 745 parts of terephthalic acid, 109 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 2].

The mass average molecular weight of the obtained [intermediate member polyester 2] was 31,000, glass transition temperature (Tg) was 38° C., acid value was 0.5 and hydroxyl value was 15.8.

Next, in a reaction vessel equipped with cooling tube, stirrer and nitrogen introducing tube, 250 parts of [intermediate member polyester 2], 17.2 parts of isophorone diisocyanate and 250 parts of ethyl acetate were put and reacted at 100° C. for 5 hours to obtain [prepolymer 2].

The rate of content of isocyanate in the obtained [prepolymer 2] was 0.58%.

Example B-3

The [toner 3] was prepared similarly to Example B-1, except for using [prepolymer 3] synthesized as follows instead of [prepolymer 1].

—Synthesis of Prepolymer 3—

In a reaction vessel equipped with cooling tube, stirrer and nitrogen introducing tube, 537 parts of neopentyl glycol, 657 parts of terephthalic acid, 96 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 3].

The mass average molecular weight of the obtained [intermediate member polyester 3] was 28,000, glass transition temperature (Tg) was 34° C., acid value was 0.5 and hydroxyl value was 16.3.

Next, in a reaction vessel equipped with cooling tube, stirrer and nitrogen introducing tube, 250 parts of [intermediate member polyester 3], 17.7 parts of isophorone diisocyanate and 250 parts of ethyl acetate were put and reacted at 100° C. for 5 hours to obtain [prepolymer 3].

The rate of content of isocyanate in the obtained [prepolymer 3] was 0.60%.

Example B-4

The [toner 4] was prepared similarly to Example B-1, except for using [prepolymer 4] synthesized as follows instead of [prepolymer 1].

—Synthesis of Prepolymer 4—

In a reaction vessel equipped with cooling tube, stirrer and nitrogen introducing tube, 623 parts of 1,6-hexanediol, 570 parts of terephthalic acid, 83 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 4].

The mass average molecular weight of the obtained [intermediate member polyester 4] was 29,000, glass transition temperature (Tg) was 31° C., acid value was 0.5 and hydroxyl value was 15.7.

Next, in a reaction vessel equipped with cooling tube, stirrer and nitrogen introducing tube, 250 parts of [intermediate member polyester 4], 16.1 parts of isophorone diisocyanate and 250 parts of ethyl acetate were put and reacted at 100° C. for 5 hours to obtain [prepolymer 4].

The rate of content of isocyanate in the obtained [prepolymer 4] was 0.59%.

Example B-5

The [toner 5] was prepared similarly to Example B-1, except for using [prepolymer 5] synthesized as follows instead of [prepolymer 1] and changing the amount of isophorone diamine from 1.3 parts to 1.2 parts.

—Synthesis of Prepolymer 5—

In a reaction vessel equipped with cooling tube, stirrer and nitrogen introducing tube, 560 parts of diethylene glycol, 570 parts of terephthalic acid, 83 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 5].

The mass average molecular weight of the obtained [intermediate member polyester 5] was 29,000, glass transition temperature (Tg) was 33° C., acid value was 0.5 and hydroxyl value was 15.7.

Next, in a reaction vessel equipped with cooling tube, stirrer and nitrogen introducing tube, 250 parts of [intermediate member polyester 5], 17.1 parts of isophorone diisocyanate and 250 parts of ethyl acetate were put and reacted at 100° C. for 5 hours to obtain [prepolymer 5].

The rate of content of isocyanate in the obtained [prepolymer 5] was 0.58%.

Example B-6

The [toner 6] was prepared similarly to Example B-1, except for using [prepolymer 6] synthesized as follows instead of [prepolymer 1].

—Synthesis of Prepolymer 6—

In a reaction vessel equipped with cooling tube, stirrer and nitrogen introducing tube, 189 parts of propylene glycol, 232 parts of ethylene glycol, 657 parts of terephthalic acid, 96 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 6].

The mass average molecular weight of the obtained [intermediate member polyester 6] was 30,000, glass transition temperature (Tg) was 34° C., acid value was 0.5 and hydroxyl value was 16.5.

Next, in a reaction vessel equipped with cooling tube, stirrer and nitrogen introducing tube, 250 parts of [intermediate member polyester 6], 18 parts of isophorone diisocyanate and 250 parts of ethyl acetate were put and reacted at 100° C. for 5 hours to obtain [prepolymer 6].

The rate of content of isocyanate in the obtained [prepolymer 6] was 0.61%.

Comparative Example B-1

The [toner 7] was prepared similarly to Example B-1, except for using [prepolymer 7] synthesized as follows instead of [prepolymer 1] and changing the amount of isophorone diamine from 1.3 parts to 3.2 parts.

—Synthesis of Prepolymer 7—

In a reaction vessel equipped with cooling tube, stirrer and nitrogen introducing tube, 682 parts of bisphenol A ethylene oxide 2-mol adduct, 81 parts of bisphenol A propylene oxide 2-mol adduct, 283 parts of terephthalic acid, 22 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 7].

The number average molecular weight of the obtained [intermediate member polyester 7] was 2,100, the mass average molecular weight was 9,500, glass transition temperature (Tg) was 55° C., acid value was 0.5 and hydroxyl value was 51.

Next, in a reaction vessel equipped with cooling tube, stirrer and nitrogen introducing tube, 410 parts of [intermediate member polyester 7], 89 parts of isophorone diisocyanate and 500 parts of ethyl acetate were put and reacted at 100° C. for 5 hours to obtain [prepolymer 7].

The rate of content of isocyanate in the obtained [prepolymer 7] was 1.53%.

Comparative Example B-2

The [toner 8] was prepared similarly to Example B-1, except for using 105 parts of [prepolymer 8] synthesized as follows instead of using 115 parts of [prepolymer 1] and changing the amount of isophorone diamine from 1.3 parts to 3.3 parts.

—Synthesis of Prepolymer 8—

In a reaction vessel equipped with cooling tube, stirrer and nitrogen introducing tube, 250 parts of propylene glycol, 350 parts of terephthalic acid, 52 parts of trimellitic anhydride and 2 parts of titanium tetrabutoxide were put and reacted at 230° C. under normal pressures for 8 hours and then reacted under reduced pressure of 10 mmHg to 15 mmHg for 5 hours to obtain [intermediate member polyester 8].

The mass average molecular weight of the obtained [intermediate member polyester 8] was 8,200, glass transition temperature (Tg) was 34° C., acid value was 0.5 and hydroxyl value was 49.

Next, in a reaction vessel equipped with cooling tube, stirrer and nitrogen introducing tube, 250 parts of [intermediate member polyester 8], 52.3 parts of isophorone diisocyanate and 250 parts of ethyl acetate were put and reacted at 100° C. for 5 hours to obtain [prepolymer 8].

The rate of content of isocyanate in the obtained [prepolymer 8] was 1.67%.

Next, heat resistant storage properties, fixing properties and electrification properties of each toner obtained in Examples B-1 to B-6 and Comparative Examples B-1 to B-2 were evaluated as follows. Results are shown in Table 4.

<Heat Resistant Storage Property>

After storing at 50° C. for 8 hours, each toner was screened for 2 minutes using a sieve of 42-mesh and the heat resistant storage property was obtained from residual ratio on the metal gauze. The toner having an appropriate heat-resistant storage property has a smaller residual ratio. The evaluation was conducted according to the following evaluation standard in 4 stages.

[Evaluation Standard]

D: 30% or more

C: 20% or more and less than 30%

B: 10% or more and less than 20%

A: less than 10%

<Fixing Property>

An image forming apparatus (imagio Neo450 manufactured by Ricoh Company, Ltd.) was adjusted so that each toner of 1.0±0.1 mg/cm$^2$ was developed to form solid images on transfer paper of regular paper and heavy paper (type 6200 manufactured by Ricoh Company, Ltd. and duplicate printing paper <135> manufactured by NBS Ricoh Co., Ltd.) while the fixing belt is adjusted to have variable temperatures. The temperature at which offset does not occur was measured with the regular paper and the lower limit of fixing temperature was measured with the heavy paper. Meanwhile, a fixing roll temperature, at which residual ratio of image density after the obtained fixed image is scraped with a pad becomes 70% or more, is defined as the lower limit of fixing temperature.

<Electrification Property>

(1) 15-Second Stirring Q/M silicone resin coat ferrite carrier (average particle diameter of 50 μm) . . . 100 parts by mass each toner . . . 4 parts by mass The above ingredients were put in a stainless steel pot until they filled 30% inner volume of the pot and stirred for 15 seconds at a stirring speed of 100 rpm and the charged amount was obtained by blow-off method.

(2) 10-Second Stirring Q/M

The charged amount after stirring for 10 minutes was obtained similarly as (1).

<Comprehensive Evaluation>

The above evaluation results were observed and evaluated comprehensively according to the following standard.

A: good

B: defect

TABLE 3

| | | Modified Polyester Resin (Prepolymer) | | | Particle Diameter of Toner | | | |
|---|---|---|---|---|---|---|---|---|
| | | | | | Volume | Number | | |
| | Toner | Alcohol Component | Acid Component | Mass Average Molecular Weight | Average Particle Diameter Dv (μm) | Average Particle Diameter Dn (μm) | Dv/Dn | Tg of Toner (° C.) |
| Ex. B-1 | Toner 1 | propylene glycol | terephthalic acid trimellitic anhydride | 28,000 | 5.01 | 4.45 | 1.13 | 46.5 |
| Ex. B-2 | Toner 2 | ethylene glycol | terephthalic acid trimellitic anhydride | 31,000 | 5.1 | 4.44 | 1.15 | 47.1 |
| Ex. B-3 | Toner 3 | neopentyl glycol | terephthalic acid trimellitic anhydride | 28,000 | 5.21 | 4.55 | 1.15 | 45.7 |
| Ex. B-4 | Toner 4 | 1,6-hexanediol | terephthalic acid trimellitic anhydride | 29,000 | 5.19 | 4.5 | 1.15 | 45.2 |
| Ex. B-5 | Toner 5 | diethylene glycol | terephthalic acid trimellitic anhydride | 29,000 | 5.11 | 4.51 | 1.13 | 46.5 |

TABLE 3-continued

| | | Modified Polyester Resin (Prepolymer) | | | Particle Diameter of Toner Volume | Particle Diameter of Toner Number | | |
|---|---|---|---|---|---|---|---|---|
| | Toner | Alcohol Component | Acid Component | Mass Average Molecular Weight | Average Particle Diameter Dv (μm) | Average Particle Diameter Dn (μm) | Dv/Dn | Tg of Toner (° C.) |
| Ex. B-6 | Toner 6 | ethylene glycol propylene glycol | terephthalic acid trimellitic anhydride | 30,000 | 5.02 | 4.47 | 1.12 | 46.8 |
| Comp. Ex. B-1 | Toner 7 | Bis A-EO adduct BisA-PO adduct | terephthalic acid trimellitic anhydride | 8,500 | 5.21 | 4.52 | 1.15 | 46.9 |
| Comp. Ex. B-2 | Toner 8 | propylene glycol | terephthalic acid trimellitic anhydride | 8,200 | 4.68 | 4.11 | 1.14 | 45.8 |

TABLE 4

| | Fixing | | | Electrification | | |
|---|---|---|---|---|---|---|
| | Lower Limit of Fixing Temperature (° C.) | Hot Offset Generation Temperature (° C.) | Heat Resistant Storage Property | 15 seconds (q/m) | 10 minutes (q/m) | Comprehensive Evaluation |
| Example B-1 | 130 | 200 | B | −19.1 | −25.5 | A |
| Example B-2 | 125 | 195 | B | −18.9 | −26.1 | A |
| Example B-3 | 120 | 185 | B | −19.5 | −25.7 | A |
| Example B-4 | 125 | 195 | B | −20.1 | −25.5 | A |
| Example B-5 | 125 | 195 | B | −21.1 | −26.7 | A |
| Example B-6 | 130 | 195 | B | −18.8 | −25.1 | A |
| Comp. Ex. B-1 | 145 | 210 | A | −10.8 | −16.1 | B |
| Comp. Ex. B-2 | 120 | 150 | D | −12.2 | −15.5 | B |

Since it is possible to pursue excellent low-temperature fixing property and offset resistance simultaneously with the toner of the present invention, the toner is favorably used for image forming of high quality.

The developer, toner container, process cartridge, image forming apparatus and image forming method of the present invention using the toner of the present invention respectively are favorably used for image forming of high quality.

What is claimed is:

1. A toner comprising:

a binder resin, and a colorant, wherein the binder resin comprises secondary modified polyester which can be obtained by cross-linking a primary modified polyester (B) derived from polyester as a precursor (A), wherein the mass average molecular weight of the precursor (A) is 10,000 to 90,000, and the glass transition temperature (Tg) of the toner is in the range of 40° C. to 55° C.

2. The toner according to claim 1, wherein the precursor (A) is modified such that functional groups capable of reacting with active hydrogen groups are introduced in the primary modified polyester (B).

3. The toner according to claim 2, wherein the functional groups contained in the primary modified polyester (B) are isocyanate groups.

4. The toner according to claim 1, wherein the secondary modified polyester is obtained by reacting the primary modified polyester (B) with an active hydrogen group-containing compound (C).

5. The toner according to claim 1, wherein the toner is granulated in an aqueous medium.

6. The toner according to claim 1, wherein the toner is produced by dispersing an oil layer containing an organic solvent in an aqueous medium to obtain an emulsified dispersion liquid, elongating and/or cross-linking the primary modified polyester (B) with an active hydrogen group-containing compound (C) in the emulsified dispersion liquid to form toner particles and removing the organic solvent in the emulsified dispersion liquid, wherein the oil layer is obtained by dissolving or dispersing a toner composition comprising the primary modified polyester (B) and the active hydrogen group-containing compound (C) in the organic solvent, and the primary modified polyester (B) comprises functional groups capable of reacting with an active hydrogen group.

7. The toner according to claim 1, wherein the glass transition temperature (Tg) of the precursor (A) is 30° C. to 50° C.

8. The toner according to claim 1, wherein the volume average particle diameter (Dv) of the toner is 3 μm to 8 μm.

9. The toner according to claim 1, wherein a ratio of the volume average particle diameter (Dv) to the number average particle diameter (Dn), Dv/Dn is 1.25 or less.

10. The toner according to claim 1, wherein the glass transition temperature (Tg) of the precursor (A) is 30° C. to 40° C.

11. The toner according to claim 1, wherein the mass average molecular weight of the precursor (A) is 10,000 to 50,000.

12. The toner according to claim 1, wherein the average molecular weight of the primary modified polyester (B) is 10,000 to 100,000.

* * * * *